US011047090B2

(12) United States Patent
Polat et al.

(10) Patent No.: US 11,047,090 B2
(45) **Date of Patent: *Jun. 29, 2021**

(54) PROCESS FOR PRODUCING STRONG AND SOFT TISSUE AND TOWEL PRODUCTS

(71) Applicant: The Procter & Gamble Company, Cincinnati, OH (US)

(72) Inventors: Osman Polat, Montgomery, OH (US); Dale Gary Kavalew, Evendale, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/502,057

(22) Filed: Jul. 3, 2019

(65) Prior Publication Data

US 2019/0323174 A1 Oct. 24, 2019

Related U.S. Application Data

(63) Continuation of application No. 15/447,843, filed on Mar. 2, 2017, now Pat. No. 10,385,508.

(60) Provisional application No. 62/312,487, filed on Mar. 24, 2016.

(51) Int. Cl.

| | |
|---|---|
| ***D21D 5/24*** | (2006.01) |
| ***D21D 99/00*** | (2006.01) |
| ***D21F 11/14*** | (2006.01) |
| ***D21B 1/02*** | (2006.01) |

(52) U.S. Cl.

CPC ..... *D21D 5/24* (2013.01); *D21B 1/026* (2013.01); *D21D 99/00* (2013.01); *D21F 11/14* (2013.01)

(58) Field of Classification Search

USPC ..... 162/118

See application file for complete search history.

(56) References Cited

U.S. PATENT DOCUMENTS

| | | | | |
|---|---|---|---|---|
| 5,228,954 | A | 7/1993 | Vinson et al. | |
| 5,411,636 | A | 5/1995 | Hermans et al. | |
| 5,679,218 | A | 10/1997 | Vinson et al. | |
| 10,385,508 | B2 * | 8/2019 | Polat | D21B 1/026 |

FOREIGN PATENT DOCUMENTS

| | | | |
|---|---|---|---|
| AU | 2004203404 | A1 | 3/2005 |
| DE | 102007027310 | A1 | 12/2008 |
| EP | 191205 | A1 | 5/2008 |
| WO | WO2007107179 | A1 | 9/2007 |
| WO | WO200803343 | A1 | 1/2008 |
| WO | WO201043766 | A1 | 4/2010 |

OTHER PUBLICATIONS

Jopson, Nigel, Coping with hardwood vessels, PPI (Pulp & Paper Intl) Magazine, 3 pages (Nov. 1, 2005).

Asikainen, Sari, et al., Evaluation of vessel picking tendency in printing, O Papel, vol. 73(1), pp. 79-85 (Jan. 2012).

PCT International Search Report dated Jun. 12, 2017 for related case 14265—13 pages.

* cited by examiner

*Primary Examiner* — Mark Halpern

(74) *Attorney, Agent, or Firm* — Richard L. Alexander

(57) ABSTRACT

A process for manufacturing a web material is disclosed. The process generally provides the steps of: a. providing a pulp material comprising fibers and vessels; b. separating said vessels from said fibers in said pulp material to form a slurry having at least about 7 percent less vessels per meter than said pulp material; and c. processing said slurry to form said web material.

20 Claims, 10 Drawing Sheets

PROCESS FOR PRODUCING STRONG AND SOFT TISSUE AND TOWEL PRODUCTS

FIELD OF THE INVENTION

The present disclosure generally relates to processes for producing cellulose pulps. More specifically, the present disclosure relates to processes for producing cellulose pulps that produce consumer tissue and towel products that have an increased softness and strength.

BACKGROUND OF THE INVENTION

A vessel, vessel element, or vessel member is one of the cell types found in xylem. Xylem is the tissue in vascular plants which conducts water (and substances dissolved in it) upwards in a plant. In a live tree, vessels serve as the pipelines within the trunk, transporting sap within the tree. Conversely, softwoods completely lack vessels, and instead rely on tracheids for sap conduction. Vessel elements are the largest type of cells, and unlike the other hardwood cell types, they can be viewed individually—oftentimes even without any sort of magnification. Vessel elements are the building blocks of vessels, which constitute the major part of the water transporting system in those plants in which they occur. Vessels form an efficient system for transporting water (including necessary minerals) from the root to the leaves and other parts of the plant.

Cellulose pulps that contain hardwood pulp fibers that include vessels are used to produce consumer tissue or towel products. Consumer tissue and towel products made from these pulp fibers that offer both improved strength and increased softness are in increasing demand. However, the known strength/softness dynamic provides that as the tissue or towel product intrinsic strength increases, the overall softness decreases. In other words, the stronger you make a consumer tissue or towel product, the harder and more rigid (and the less soft) it becomes.

Further, as the world's supply of native softwood fibers become increasingly scarcer and more expensive, it has become necessary to consider lower cost, and more abundant, sources of cellulose to make paper products. This has caused a broader interest in papermaking with traditionally lower quality sources of fiber such as high lignin-content fibers and hardwood fibers, as well as fibers from recycled paper. Unfortunately, these sources of fiber often result in the comparatively severe deterioration of the strength characteristics of paper compared to conventional virgin chemical pulp furnishes.

Because of the above-mentioned reasons, pulps and processing methods of increasing the intrinsic sheet strength and the intrinsic sheet softness of consumer tissue and towel products produced by fibrous pulps are of great interest.

One method described herein can be used for the centrifugal separation of fibers having different apparent specific gravities (e.g., by classifying fibers by width). The resulting fractions can yield a pulp that can be used to produce a web product that has higher wet tensile and a higher overall softness than currently available products. In other words, it would be desirable to provide a cellulose pulp that produces a consumer relevant tissue or towel product that offers a higher level of wet tensile strength and a higher level of softness. Such a product would fly in the face of the known strength vs. softness dynamic and provide a consumer with a more enjoyable user experience.

SUMMARY OF THE INVENTION

The present disclosure provides a process for manufacturing a web material. The process generally comprises the steps of: a. providing a pulp material comprising fibers and vessels; b. separating the vessels from the fibers in said pulp material to form a slurry having at least about 7 percent less vessels per ton than said pulp material; and, c. processing the slurry to form the web material.

The present disclosure also provides a process for manufacturing a papermaking slurry. The process comprises the steps of: a. providing a pulp material comprising fibers and vessels; and, b. separating the vessels from the fibers in the pulp material to form the papermaking slurry having at least about 7 percent less vessels per meter than said pulp material.

The present disclosure further provides a process for manufacturing a papermaking slurry. The process comprises the steps of: a. providing a pulp material comprising fibers; b. separating fibers having an average width of at less than about 50 μM from the pulp material; and, c. forming the papermaking slurry from the separated fibers.

DETAILED DESCRIPTION OF THE INVENTION

Figure 1:
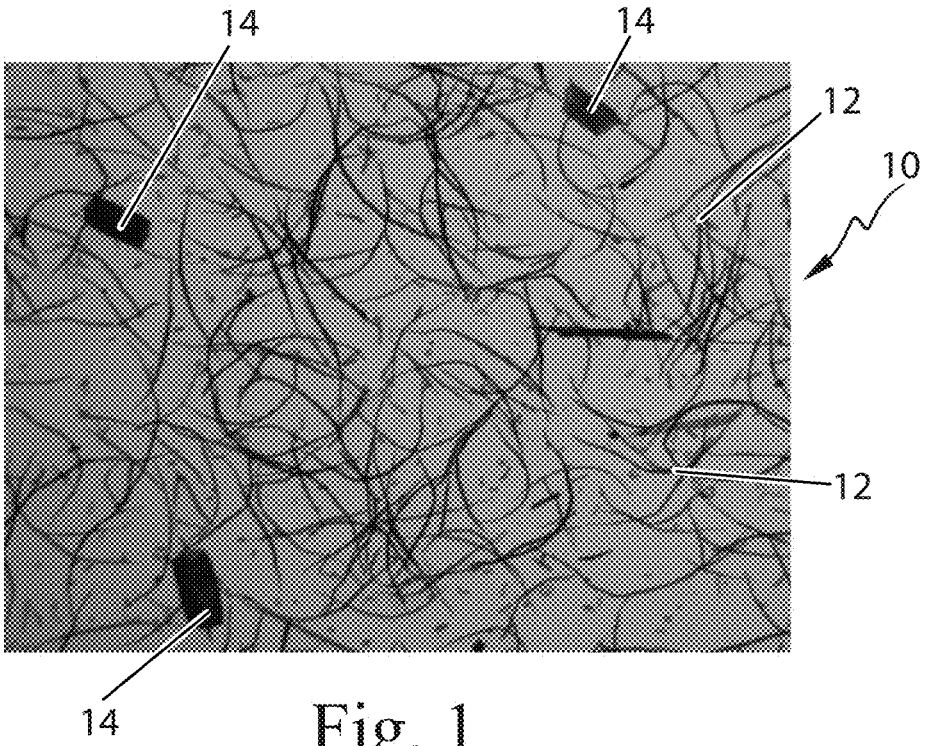
FIG. 1 is a photomicrograph of a portion of an exemplary *Eucalyptus* pulp material showing straight fibers and vessels.

Briefly, the present disclosure relates to a cellulose pulp-making process that provides improved levels of strength and softness in fibrous structures and/or sanitary tissue product produced by the pulp so processed. Heretofore unachievable levels of strength and softness are made possible by selecting fibers of preferred morphology from cellulose pulp sources by the process described herein.

"Fractionation" as used herein is a screening process in which fibrous papermaking pulp slurry is separated into at least two fractions of fibers having different fiber widths. Several methods to segregate fibers by width are envisioned. While not intended to be construed as limiting the present invention to a certain set of process steps, the following illustrates several methods of preparing cellulose pulps that can comply according to the specifications of the present disclosure. These include methods of fractionating fibers by a combination of size and shape. Also included are certain methods employing a mechanical pre-treatment step, before fractionating the fibers, according to size and shape.

The first utilizes a process for separating fibers by the use of a hydraulic cyclone. Generally, a fibrous pulp slurry is charged to a cyclone and separated into a slurry fraction that contains fibers having a lower average width and a slurry fraction that contains fibers of higher average width.

The second fractionation process also provides two fractions of fibers having different fiber width. A fibrous pulp slurry is directed toward an apertured screen. A slurry fraction containing fibers having a lower width passes through the apertures and a slurry fraction containing fibers having a higher average width are retained by the screening process.

In any regard, quantities of water are required for forming the slurries at each stage of the process. Since water reuse would normally be desired in any of the process methods, a water clarifier working on the principal of injecting air to create air bubbles which attach to solid particles and cause them to rise to the surface where they may be collected. This can leave substantially solids-free water which can be reused to create the pulp slurries.

As used herein, the term "morphology" refers to the various physical forms of wood fibers including such characteristics as fiber type, fiber length, fiber width, cell wall thicknesses, coarseness, and similar characteristics, determined both on the basis of bulk average properties as well as on a local or distributive basis. The term "selected morphology" refers to fibers which have been selected from the general class of fibers to provide enhanced performance with regard to tensile strength and softness.

The term "tensile strength" refers to the tensile strength of the substrates made from the pulps as described below. Preferably, the tensile strength potential of pulps of the present invention is from about 200 g/in to about 4000 g/in, or from about 300 to about 2500 g/in, or from about 400 g/in to about 900 g/in.

As used herein, "softness" is a subjective property of a web substrate (e.g. bath tissue) that can be measured by a sensory panel of selected consumers brought to a central location for conducting the tests or by consumers carrying out a home use test where products are given to them to use and their perceptions are recorded by means of a questionnaire "Vessels" are composed of single cells. Their size and distribution within the growth ring of the tree vary according to the species. Vessel elements are shorter than hardwood fibers, and the diameter of vessels varies greatly from species to species. In general, there is about 3 to 25 vessels/$mm^2$ of *eucalyptus* xylem cross section. Some species have more vessels than others. There is also much variation between the dimensions of vessel elements, but have mostly a diameter ranging from 60 μm to 250 μm and a length between 200 μm to 600 μm. Species rich in wide diameter vessels may reach approximately 25% to 30% of its volume in vessels. In most commercial *eucalyptus* species, the proportion of vessels by volume can range from 10% to 20%.

A vessel wall is relatively thin, practically equal to the fiber wall thickness, and can range between 2.5 μm and 5 μm. The chemical composition of the vessels is similar to that of the fiber in its chemical constituents, but there are some differences between fibers and vessels. Vessel elements have been found to be richer in cellulose compared with fibers, and lignin has been found in vessel elements even after bleaching. There are also indications that the lignin in vessels is more hydrophobic, richer in guaiacyl units than in syringyl. The syringyl to guaiacyl ratio may reach about 0.5 to 1 for the vessels, while that of fibers is from 2 to 6. It was also found that the xylan content of vessel elements is higher than that of the fibers.

Process

The process of the present disclosure provides for the width-wise fractionation of mill dried pulps. These exemplary mill dried pulps were allowed to swell overnight and disintegrated using a 50-liter disintegrator the next morning. The disintegration time was 15 minutes with a pulp consistency about 5%. The exemplary pulps were fractionated using a 3" hydrocyclone. Trials were performed with feed pulp consistency of 0.1% and differential pressure was 1.6 bar. The trial configuration for *Eucalyptus globulus* is shown in FIG. 7A. As referenced herein, the untreated *eucalyptus* pulp fed to the hydrocyclone is called "feed pulp", the vessel-poor pulp fraction is referenced as the "accept pulp" or "accepts", and the vessel-rich pulp fraction is referenced as the "reject pulp" or "rejects".

FIG. 1 is a photomicrograph of an exemplary *Eucalyptus* fiber feed pulp 10 showing both fibers 12 and vessels 14. As can be seen, there are numerous vessels 14 distributed throughout the fiber feed pulp 10 and intermixed with the fibers 12.

Figure 2:
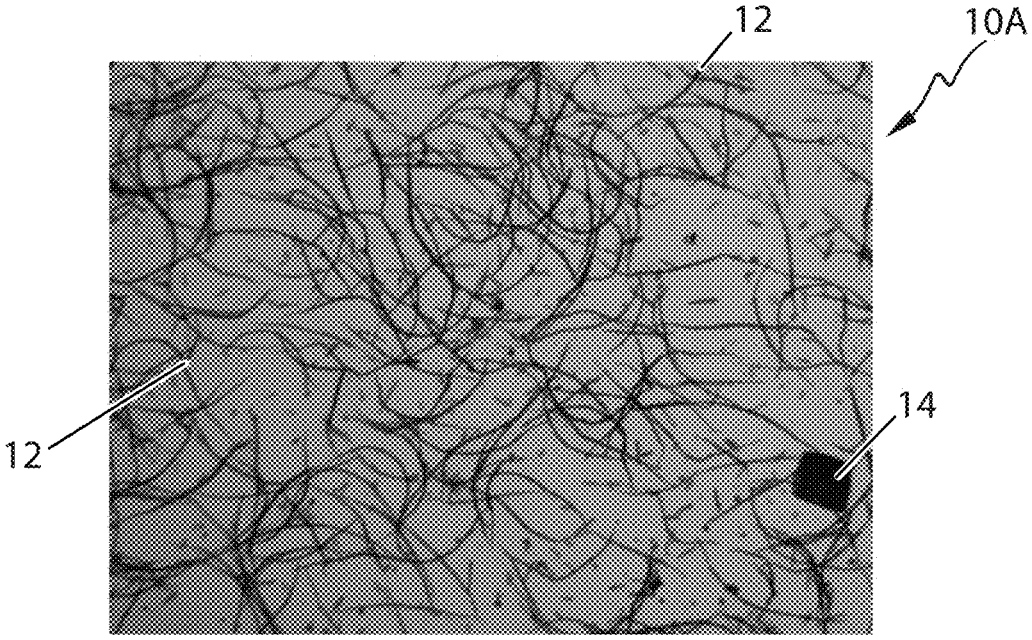
FIG. 2 is a photomicrograph of a portion of an exemplary *Eucalyptus* pulp material first stage fractionation "accept" stream showing a reduced presence of *Eucalyptus* vessels.

FIG. 2 depicts an exemplary photomicrograph of an accept pulp product 10A showing an increased percentage of fibers 12 relative to the number of vessels 14. In short, the single-stage fractionation process resulted in a marked decrease in the number of vessels 14 per ton of fiber feed pulp 10. The percentage of vessels/meter of the feed pulp decreased from about 7%/meter to about 5%/meter to provide the accept pulp product 10A as determined by the Pulp Fiber and Vessel Measurement Method (Fiber Quality Analysis) provided infra. One of skill in the art could extrapolate this data to also provide a decrease in the percentage of vessels/meter of the feed pulp from about 7%/ton to about 5%/ton to provide the accept pulp product 10A.

Table 1 provides relevant data based upon the analysis of the various pulp streams of the fractionation process using a Beloit Posiflow Cleaner with a smooth-tapered tip. This includes the feed pulp 10 stream (e.g., *Eucalyptus* raw pulp fibers), fiber 12 stream (i.e., accepts), and vessel 14 stream (i.e., rejects). As can be seen from the data presented, the average fiber 12 stream (i.e., accepts) shows a decrease in vessel 14 content of about 6 percent. Additionally, the data indicates that the average vessel 14 content in the vessel 14 stream (i.e., rejects) increases about 250 percent.

TABLE 1

Relevant data relative to the hydro-cycloning of *Eucalyptus* pulp as analyzed by Fiber Quality Analyzer

| Sample ID | Vessels/ meter | Vessels/gram | Mean fiber width, μM | Mean Vessel Effective Width, μM |
|---|---|---|---|---|
| Base Euc #1 | 6.21 | 110967 | 18.2 | 123.1 |
| Base Euc #2 | 5.80 | 103521 | 17.7 | 111.5 |
| Base Euc #3 | 6.42 | 114620 | | 119.0 |
| Accepts #1 | 5.73 | 104178 | 17.2 | 111.1 |
| Accepts #2 | 5.82 | 105738 | 17.3 | 112.9 |
| Accepts #3 | 5.40 | 98244 | | 116.7 |
| Rejects #1 | 15.20 | 245180 | 17.4 | 120.9 |
| Rejects #2 | 19.07 | 307594 | 18.2 | 122.2 |
| Rejects #3 | 16.70 | 269374 | | 125.0 |

Exemplary fractionation results from the fractionation of *Eucalyptus* feed pulp at different process conditions are provided in Table 4 infra.

Figure 3:
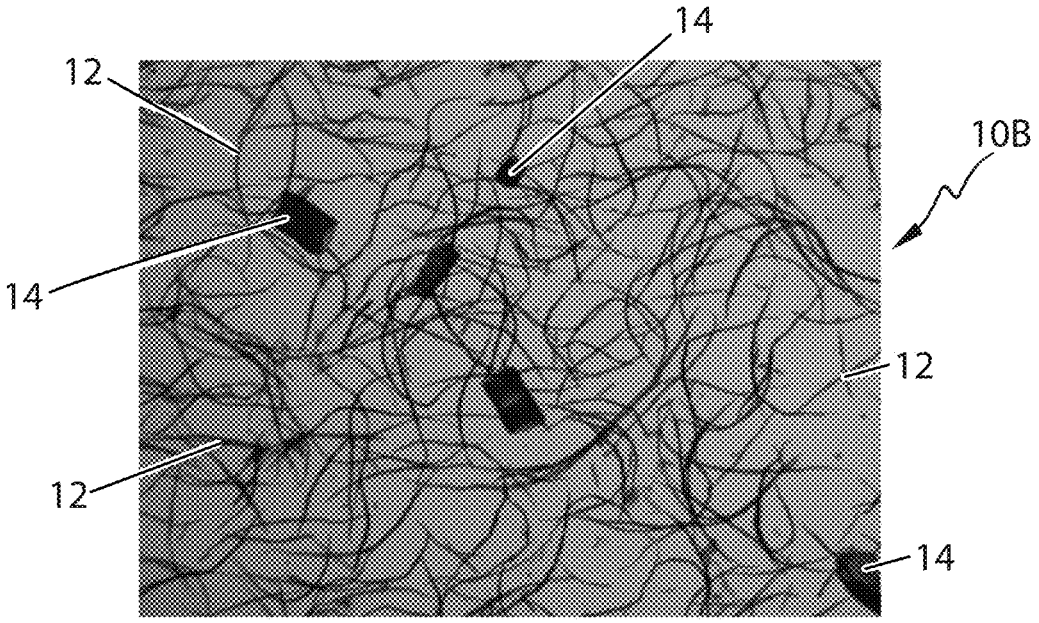
FIG. 3 is a photomicrograph of a portion of an exemplary *Eucalyptus* pulp material first stage fractionation "reject" stream showing an increased presence of *Eucalyptus* vessels.

Contrastingly, FIG. 3 depicts an exemplary photomicrograph of a reject stream pulp product 10B showing an increased percentage of vessels 14 relative to the number of fibers 12. In short, the single-stage fractionation process resulted in a marked increase in the number of vessels/ton of feed pulp material. The percentage of vessels/meter of pulp increased from about 7%/meter to about 15%/meter as determined by the Pulp Fiber and Vessel Measurement Method (Fiber Quality Analysis) provided infra. One of skill in the art could extrapolate this data to also provide an increase in the percentage of vessels/meter of the feed pulp from about 7%/ton to about 5%/ton to provide the accept pulp product 10A.

Figure 4:
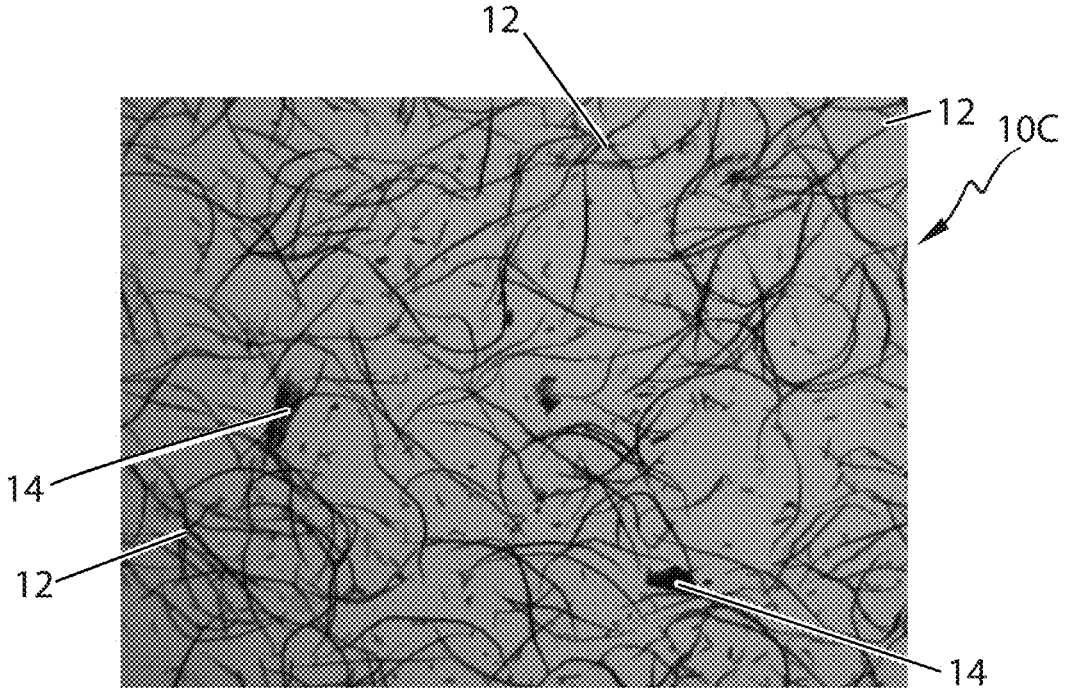
FIG. 4 is a photomicrograph of a portion of an exemplary *Eucalyptus* pulp material second stage fractionation "accept" stream showing a reduced presence of *Eucalyptus* vessels.

FIG. 4 provides a photomicrograph of an exemplary accept stream product 10C yield from an exemplary 2-stage fractionation process. As shown, the relative percentage of fibers 12 relative to the number of vessels 14 increased. It should be noted that the reject stream of FIG. 3 provided the feed pulp for the exemplary 2-stage process that produced the accept stream pulp.

Figure 5:
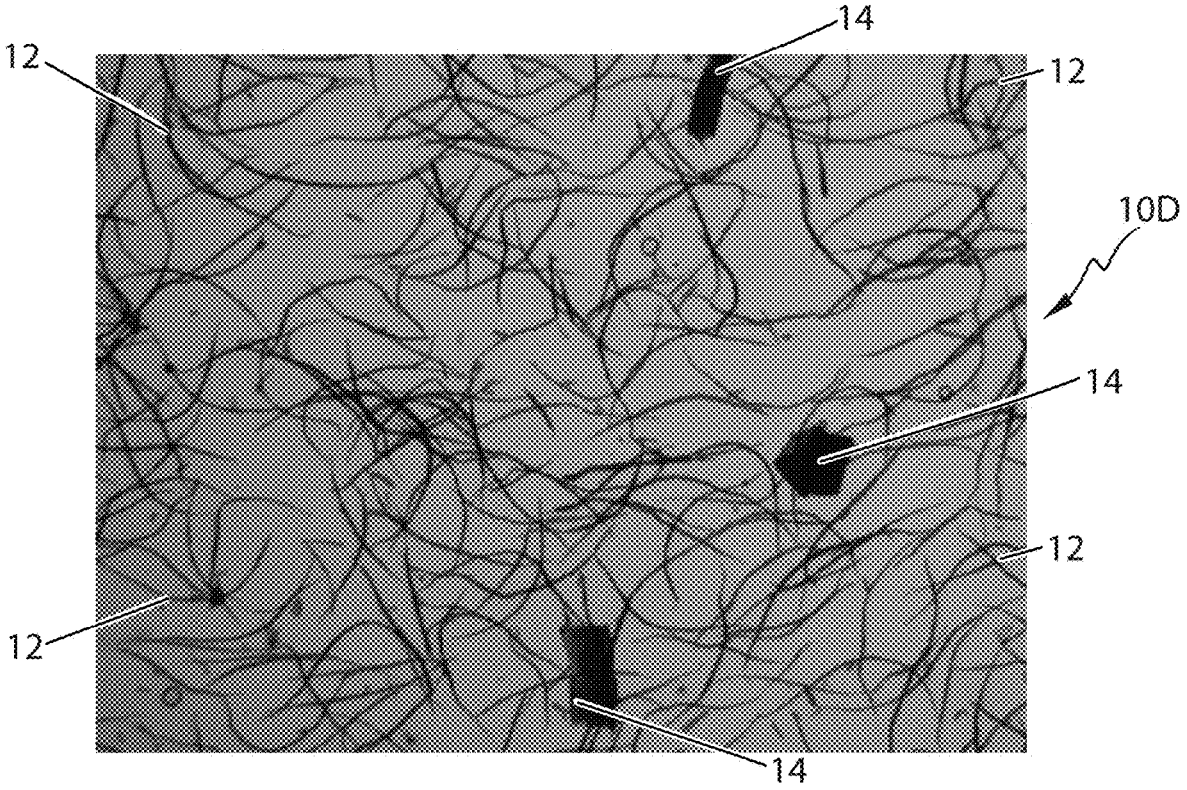
FIG. 5 is a photomicrograph of a portion of an exemplary *Eucalyptus* pulp material second stage fractionation "reject" stream showing an increased presence of *Eucalyptus* vessels.

Again, contrastingly, an exemplary reject stream product 10D from the second stage of a 2-stage fractionation process shown in FIG. 5 shows an increased amount of vessels 14 relative to the number of fibers 12.

Figure 6:
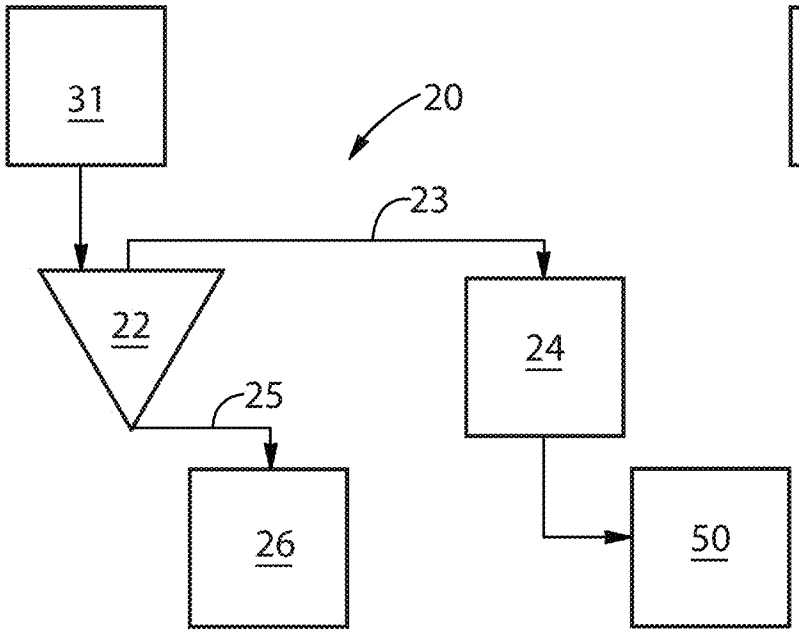
FIG. 6 is a flow diagram of an exemplary 1-stage fractionation process.

As shown in FIG. 6, *Eucalyptus globulus* hardwood feed pulp 31 can be treated by a fractionation process 20 in a single-stage pulp fractionation system 22. Two product streams (i.e., first product stream 23 and second product stream 25) are created by the single-stage pulp fractionation system 22. The first product stream 23 results in accept product 24 having a lower percentage of vessels 14 than the feed pulp 31. The second product stream 25 results in reject product 26 having a higher percentage of vessels 14 than the feed pulp 31.

Figure 7:
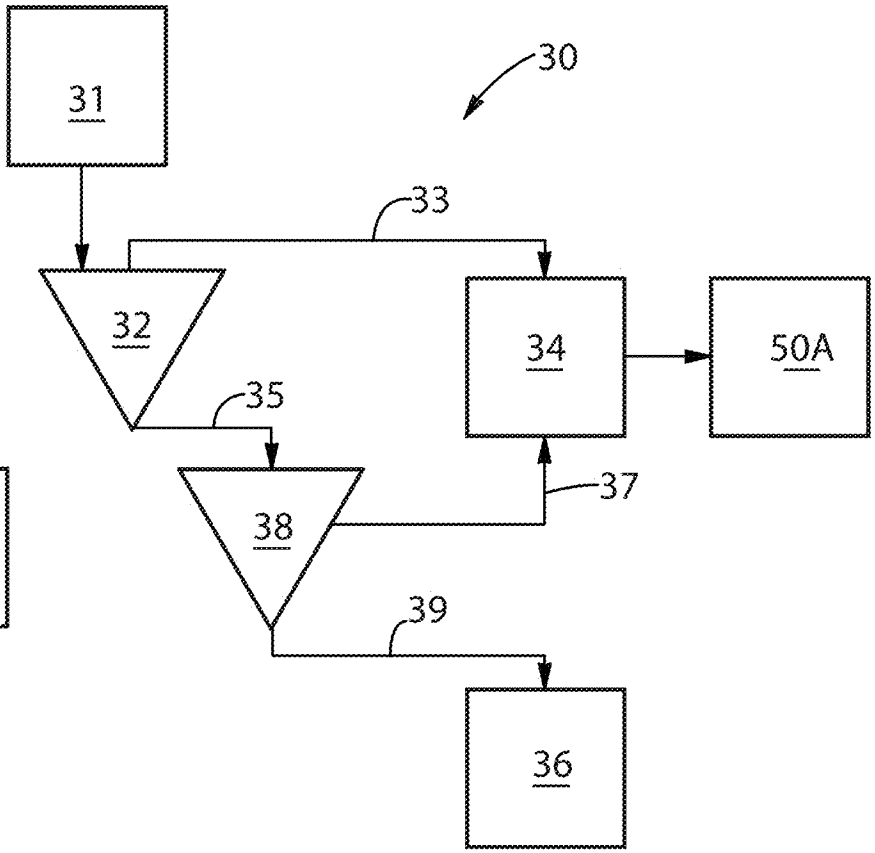
FIG. 7 is a flow diagram of an exemplary 2-stage fractionation process.
Figure 7A:
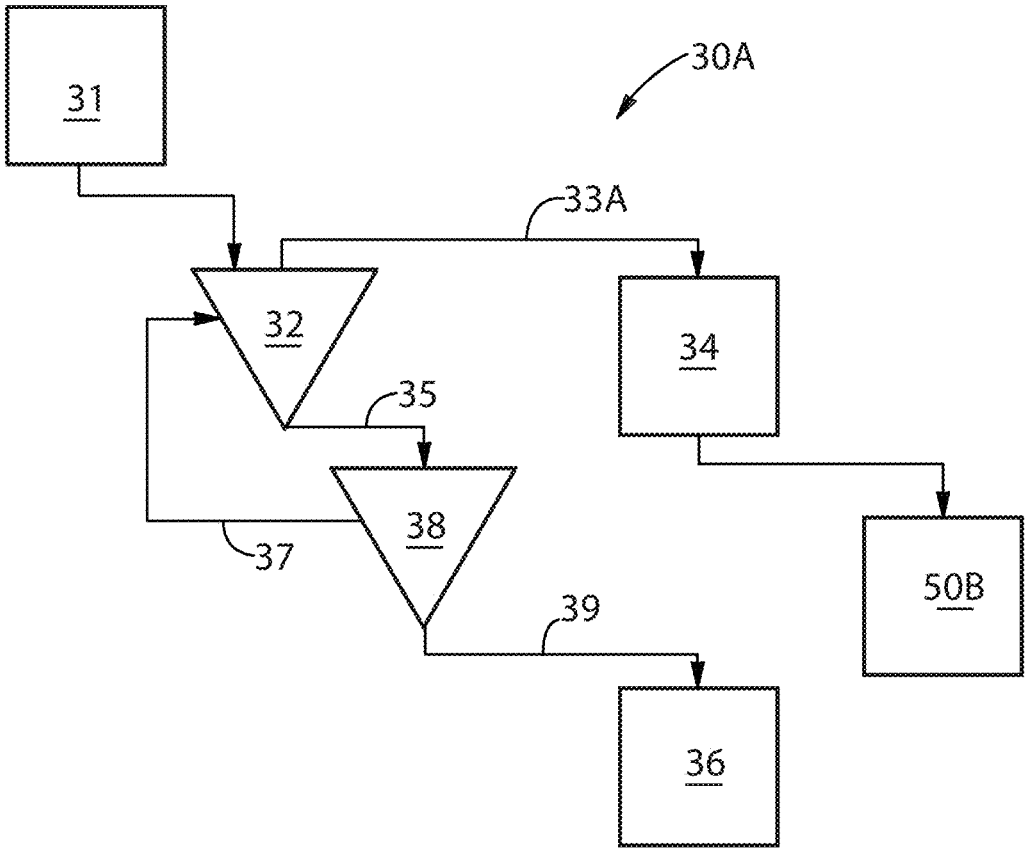
FIG. 7A is a flow diagram of another exemplary 2-stage fractionation process.

As shown in FIG. 7, one of skill in the art will appreciate that fractionation of *Eucalyptus globulus* hardwood feed pulp 31 can also occur in a process 30 incorporating a two-stage system 32, 38. Four product streams 33, 35, 37, 39 are created by the two-stage pulp fractionation system 32, 38. Here, the first stage 32 creates two product streams 33, 35. The first product stream 33 results in accept product 33 having a lower percentage of vessels 14 than the feed pulp 31. The second product stream 35 results in reject product 36 having a higher percentage of vessels 14 than the feed pulp 31. The second product stream 35 provides the input pulp stream feed to the second stage 38. The second stage 38 provides a third product stream 37 resulting in additional accept product 34 having a lower percentage of vessels 14 than the feed pulp. The fourth product stream 39 results in additional reject product 36 having a higher percentage of vessels 14 than the feed pulp 31.

As shown in FIG. 7A, an alternative fractionation of hardwood feed pulp 31 (such as *Eucalyptus globulus*) can also occur in a process 30A incorporating a two-stage system 32, 38. Four product streams 33A, 35, 37, 39 are created by the two-stage pulp fractionation system 32, 38. Here, the first stage 32 creates two product streams 33A, 35. The first product stream 33A can result in accept product 34 having a lower percentage of vessels 14 than the feed pulp 31. The second product stream 35 results in reject product having a higher percentage of vessels 14 than the feed pulp 31. The second product stream 35 provides the input feed pulp stream feed to the second stage 38. The second stage 38 provides a third product stream 37 resulting in additional accept fibers 12 having a lower percentage of vessels 14 than the second product stream 35. The fourth product stream 39 results in additional reject product 36 having a higher percentage of vessels 14 than the feed pulp 31. The third product stream 37 provides an additional feed pulp to the input of first stage 32. This can result in the increased amount of accept fibers 12 provided into first product stream 33A.

In any regard, the accept pulp of each stage can be recovered and saved. The reject pulp stream of any preceding stage can then be fed to any successive stage. For example, the accept pulp from the second stage can be recovered, combined with the accept pulp of the first stage, and saved. One of skill in the art will understand that the reject pulp stream of the first stage can be fed to a second stage and the reject pulp stream of the second stage can be fed to third stage, etc.

After each fractionation stage the pulp samples can be analyzed with an OpTest Equipment, Inc. Fiber Quality Analyzer to determine the number, length, and width of the respective fibers and vessel elements to monitor separation efficiency, as well as other fiber properties.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Differential density", as used herein, means fibrous structures and/or sanitary tissue products that comprise one or more regions of relatively low fiber density, which are referred to as pillow regions, and one or more regions of relatively high fiber density, which are referred to as knuckle regions.

"Densified", as used herein means a portion of a fibrous structure and/or sanitary tissue product that is characterized by regions of relatively high fiber density (i.e., knuckle regions).

"Non-densified", as used herein, means a portion of a fibrous structure and/or sanitary tissue product that exhibits a lesser density (one or more regions of relatively lower fiber density) (pillow regions) than another portion (for example a knuckle region) of the fibrous structure and/or sanitary tissue product.

"3D pattern" with respect to a fibrous structure and/or sanitary tissue product's surface in accordance with the present invention means herein a pattern that is present on at least one surface of the fibrous structure and/or sanitary tissue product. The 3D pattern texturizes the surface of the fibrous structure and/or sanitary tissue product, for example by providing the surface with protrusions and/or depressions. The 3D pattern on the surface of the fibrous structure and/or sanitary tissue product can be made by making the sanitary tissue product or at least one fibrous structure ply employed in the sanitary tissue product on a patterned molding member that imparts the 3D pattern to the sanitary tissue products and/or fibrous structure plies made thereon. For example, the 3D pattern may comprise a series of line elements, such as a series of line elements that are substantially oriented in the cross-machine direction of the fibrous structure and/or sanitary tissue product. Additionally, a 3D pattern on the surface of the fibrous structure and/or sanitary tissue product can be made by embossing the sanitary tissue product by techniques understood by one of skill in the art.

Referring again to FIGS. 6-7 and 7A, the accept pulp was then utilized to form a papermaking slurry 50, 50A, 50B. The enhanced pulps of the present invention are suitable for use in a wide variety of papers and papermaking processes. The cellulose pulps are particularly suitable for use in making papers having densities of <0.15 g/cc. Papers having such low density (i.e., <0.15 g/cc) and low basis weight (i.e., <30 $g/m^2$) are especially suitable for use as tissue paper and paper towels.

One manner of forming a tissue and/or towel product of the present disclosure incorporates the deposition of the papermaking furnish having a baseline, increased, or reduced vessel number content on a foraminous forming wire, often referred to in the art as a Fourdrinier wire. From the time a furnish is deposited on the forming wire, it is referred to as a "web material". In short, the web material is dewatered by pressing the web and drying at elevated temperature. In a typical process, a low consistency pulp furnish is provided from a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations. Preferably, the furnish is first formed into a wet web on a foraminous forming carrier, such as a Fourdrinier wire. The web is dewatered and transferred to an imprinting fabric. The furnish can alternately be initially deposited on a foraminous supporting carrier that also operates as an imprinting fabric. Once formed, the wet web is dewatered and, preferably, thermally pre-dried to a selected fiber consistency of between about 40% and about 80%.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include melt-blown and/or spun-bond filaments. Non-limiting examples of materials that can be spun into filaments include natural polymers, such as starch, starch derivatives, cellulose and cellulose derivatives, hemi-cellulose, hemi-cellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multi-component, such as bi-component filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, ground wood, thermomechanical pulp, and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. Also applicable to the present invention are fibers derived from recycled paper, which may contain any or all of the above categories as well as other non-fibrous materials such as fillers and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: *eucalyptus* fibers, acacia fibers, and mixtures thereof. The northern hardwood pulp fibers may be selected from the group consisting of: aspen, balsam, poplar, maple fibers, and mixtures thereof. In addition to the various wood pulp fibers, other cellulosic fibers such as cotton linters, rayon, lyocell, trichomes, seed hairs, and bagasse can be used. Other sources of cellulose in the form of fibers or capable of being spun into fibers include grasses and grain sources.

Figure 8:
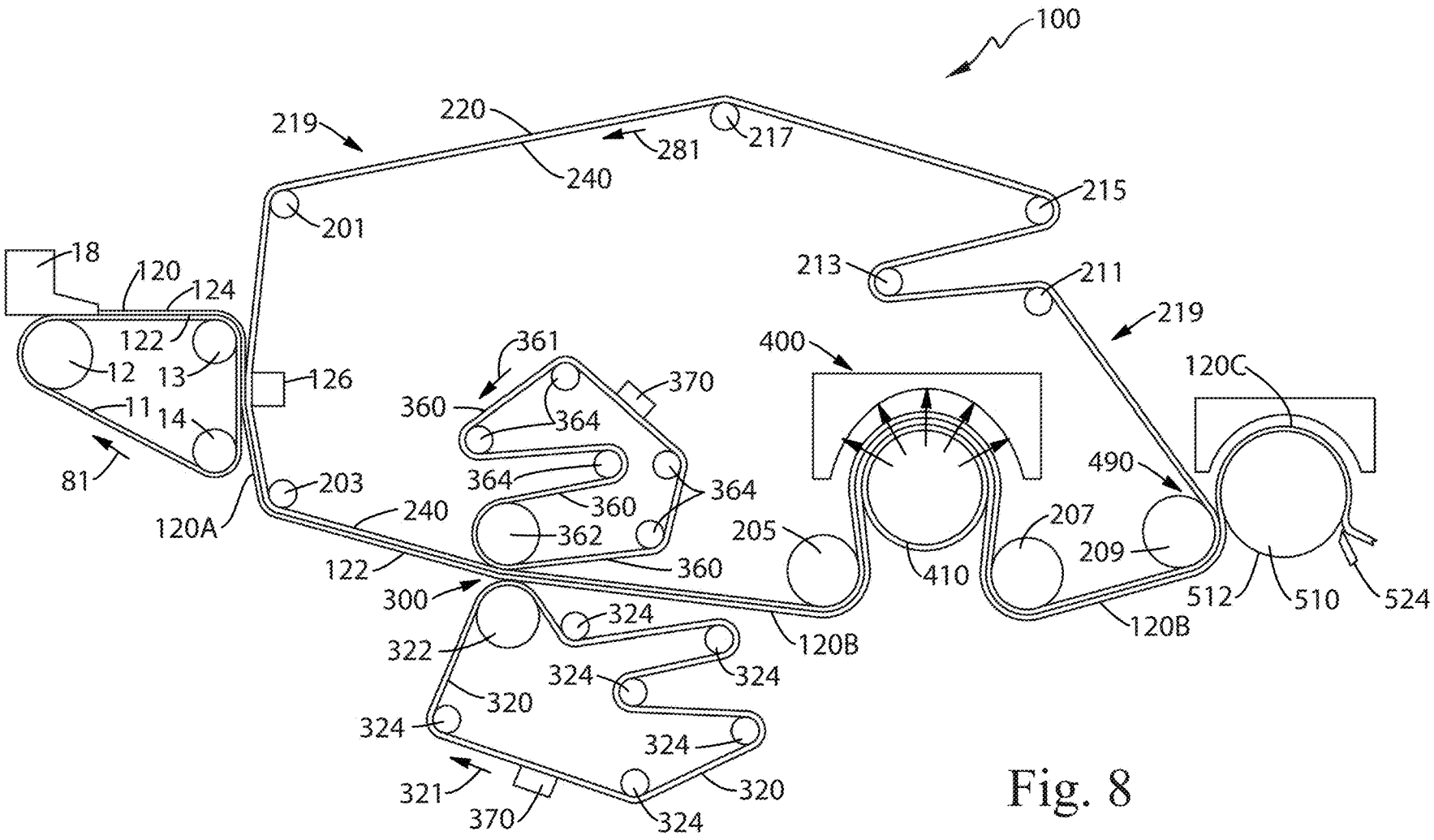
FIG. 8 is a schematic diagram of an exemplary papermaking process suitable for producing consumer tissue and towel products having increased strength and softness and manufactured with a pulp having a reduced number of "vessels"

By way of example only, FIG. 8 provides an exemplary embodiment of a continuous papermaking machine 100 that can be used in practicing the process of the present invention. The process of the present invention comprises a number of steps or operations which occur in sequence. While the process of the present invention is preferably carried out in a continuous fashion, it will be understood that the present invention can comprise a batch operation, such as a hand sheet making process. A preferred sequence of steps will be described, with the understanding that the scope of the present invention is determined with reference to the appended claims.

According to one embodiment of the present invention, an embryonic web 120 of papermaking fibers having certain measureable physical properties such as basis weight, topography, caliper, tension, fiber orientation, moisture content, MD and/or CD tensile strength, and/or MD and/or CD web stretch, combinations thereof, and the like, is formed from an aqueous dispersion of papermaking fibers on a foraminous forming member 11. The embryonic web 120 is then transferred to a foraminous imprinting member 219 having a first web contacting face 220 comprising a web imprinting surface and a deflection conduit portion. If desired, a portion of the papermaking fibers in the embryonic web 120 can be deflected into deflection conduit portion of the foraminous imprinting member 219 without densifying the web, thereby forming an intermediate web 120A.

The intermediate web 120A is carried on the foraminous imprinting member 219 from the foraminous forming member 11 to a compression nip 300 formed by opposed compression surfaces on first and second nip rolls 322 and 362. A first dewatering felt 320 is positioned adjacent the intermediate web 120A, and a second dewatering felt 360 is positioned adjacent the foraminous imprinting member 219. The intermediate web 120A and the foraminous imprinting member 219 are then pressed between the first and second dewatering felts 320 and 360 in the compression nip 300 to further deflect a portion of the papermaking fibers into the deflection conduit portion of the imprinting member 219; to densify a portion of the intermediate web 120A associated with the web imprinting surface; and to further dewater the web by removing water from both sides of the web, thereby forming a molded web 120B which is relatively dryer than the intermediate web 120A. One of skill in the art will recognize that it is not necessary to include a step of pressing the intermediate web 120A between the first and second dewatering felts 320 and 360 in a compression nip.

The molded web 120B is carried from the compression nip 300 on the foraminous imprinting member 219. The molded web 120B can be pre-dried in a through-air dryer 400 by directing heated air to pass first through the molded web, and then through the foraminous imprinting member 219, thereby further drying the molded web 120B. The web imprinting surface of the foraminous imprinting member 219 can then be impressed into the molded web 120B such as at a nip formed between a roll 209 and a dryer drum 510, thereby forming an imprinted web 120C. Impressing the web imprinting surface into the molded web can further densify the portions of the web associated with the web imprinting surface. The imprinted web 120C can then be dried on the dryer drum 510 (such as a Yankee dryer) and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene, polyester, and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, ground wood, thermo-mechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make paper product structures may have other components or materials added thereto as may be or later become known in the art. The types of additives desirable will be dependent upon the particular end use of the paper product sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of dispersion, slurry, web, or other system is defined as 100 times the quotient obtained when the weight of dry fiber in the system under discussion is divided by the total weight of the system. Fiber weight is always expressed on the basis of bone dry fibers.

Referring again to FIG. 8, a second step in the practice of the present invention is forming the embryonic web 120 of papermaking fibers. An aqueous dispersion of papermaking fibers is provided to a head box 18 which can be of any convenient design. From the head box 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025. While a single forming member 11 is shown in FIG. 8, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 8. The forming member 11 is driven in the direction indicated by the arrow 81 by a drive means (not shown). The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 8, or alternatively, a batch process, such as a hand-sheet making process can be used. In any regard, after the aqueous dispersion of papermaking fibers is deposited onto the foraminous forming member 11, an embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and brought into the proximity of a foraminous imprinting member 219 described infra.

A third step in the practice of the present invention comprises transferring the embryonic web 120 from the foraminous forming member 11 to the foraminous imprinting member 219, to position the second web face 124 on the first web contacting face 220 of the foraminous imprinting member 219. Although the preferred embodiment of the foraminous imprinting member 219 of the present invention is in the form of an endless belt, it can be incorporated into numerous other forms which include, for instance, stationary plates for use in making hand sheets or rotating drums for use with other types of continuous process. Regardless of the physical form which the foraminous imprinting member 219 takes for the execution of the claimed invention, it is generally provided with the physical characteristics detailed infra.

A fourth step in the practice of the present invention comprises deflecting a portion of the papermaking fibers in the embryonic web 120 into the deflection conduit portion 230 of web contacting face 220 of the foraminous imprinting member 219, and removing water from the embryonic web 120 through the deflection conduit portion 230 of the foraminous imprinting member 219 to form an intermediate web 120A of the papermaking fibers. The embryonic web 120 preferably has a consistency of between about 10 and about 20 percent at the point of transfer to facilitate deflection of the papermaking fibers into the deflection conduit portion 230 of the foraminous imprinting member 219.

The steps of transferring the embryonic web 120 to the imprinting member 219 and deflecting a portion of the papermaking fibers in the web 120 into the deflection conduit portion 230 of the foraminous imprinting member 219 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG. 8, or alternatively, by a rotary pickup vacuum roll (not shown). The pressure differential across the embryonic web 120 provided by the vacuum source (e.g. the vacuum box 126) deflects the fibers into the deflection conduit portion 230, and preferably removes water from the web through the deflection conduit portion 230 to raise the consistency of the web to between about 18 and about 30 percent. The pressure differential across the embryonic web 120 can range from between about 13.5 kPa and about 40.6 kPa (between about 4 to about 12 inHg). The vacuum provided by the vacuum box 126 permits transfer of the embryonic web 120 to the foraminous imprinting member 219 (with or without a speed differential) and deflection of the fibers into the deflection conduit portion 230 without compacting the embryonic web 120. Additional vacuum boxes (not shown) can be included to further dewater the intermediate web 120A.

A fifth step in the practice of the present invention comprises pressing the wet intermediate web 120A in the compression nip 300 to form the molded web 120B. Referring again to FIG. 8, the intermediate web 120A is carried on the foraminous imprinting member 219 from the foraminous forming member 11 and through the compression nip 300 formed between opposed compression surfaces on nip rolls 322 and 362. The first dewatering felt 320 is shown supported in the compression nip by the nip roll 322 and driven in the direction 321 around a plurality of felt support rolls 324. Similarly, the second dewatering felt 360 is shown supported in the compression nip 300 by the nip roll 362 and driven in the direction 361 around a plurality of felt support rolls 364. A felt dewatering apparatus 370, such as an Uhle vacuum box can be associated with each of the dewatering felts 320 and 360 to remove water transferred to the dewatering felts from the intermediate web 120A.

The nip rolls 322 and 362 can have generally smooth opposed compression surfaces, or alternatively, the rolls 322 and 362 can be grooved. In an alternative embodiment (not shown) the nip rolls can comprise vacuum rolls having perforated surfaces for facilitating water removal from the intermediate web 120A. The rolls 322 and 362 can have rubber coated opposed compression surfaces, or alternatively, a rubber belt can be disposed intermediate each nip roll and its associated dewatering felt. The nip rolls 322 and 362 can comprise solid rolls having a smooth, bone-hard rubber cover, or alternatively, one or both of the rolls 322 and 362 can comprise a grooved roll having a bone-hard rubber cover.

The term "dewatering felt" as used herein refers to a member that is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof.

A preferred but non-limiting dewatering felt 320, 360 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter, and an air permeability of between about 15 and about 110 cubic feet per minute per square foot, at a pressure differential across the dewatering felt thickness of 0.12 kPa (0.5 inch of water). The dewatering felt 320 preferably has first surface 325 having a relatively high density, relatively small pore size, and a second surface 327 having a relatively low density, relatively large pore size. Likewise, the dewatering felt 360 preferably has a first surface 365 having a relatively high density, relatively small pore size, and a second surface 367 having a relatively low density, relatively large pore size. The relatively high density and relatively small pore size of the first felt surfaces 325, 365 promote rapid acquisition of the water pressed from the web in the nip 300. The relatively low density and relatively large pore size of the second felt surfaces 327, 367 provide space within the dewatering felts for storing water pressed from the web in the nip 300. Suitable dewatering felts 320 and 360 are commercially available as SUPERFINE DURAMESH, style XY31620 from the Albany International Company of Albany, N.Y.

The intermediate web 120A and the web imprinting surface 222 are positioned intermediate the first and second felt layers 320 and 360 in the compression nip 300. The first felt layer 320 is positioned adjacent the first face 122 of the intermediate web 120A. The web imprinting surface 222 is positioned adjacent the second face 124 of the web 120A. The second felt layer 360 is positioned in the compression nip 300 such that the second felt layer 360 is in flow communication with the deflection conduit portion 230.

Referring again to FIG. 8, the first surface 325 of the first dewatering felt 320 is positioned adjacent the first face 122 of the intermediate web 120A as the first dewatering felt 320 is driven around the nip roll 322. Similarly, the first surface 365 of the second dewatering felt 360 is positioned adjacent the second felt contacting face 240 of the foraminous imprinting member 219 as the second dewatering felt 360 is driven around the nip roll 362. Accordingly, as the intermediate web 120A is carried through the compression nip 300 on the foraminous imprinting fabric 219, the intermediate web 120A, the imprinting fabric 219, and the first and second dewatering felts 320 and 360 are pressed together between the opposed surfaces of the nip rolls 322 and 362. Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320 and 360. Water is received by the dewatering felt 360 through the deflection conduit portion 230 of the imprinting member 219.

The molded web 120B is preferably pressed to have a consistency of at least about 30 percent at the exit of the compression nip 300. Pressing the intermediate web 120A as shown in FIG. 8 molds the web to provide a first relatively high density region associated with the web imprinting surface 222 and a second relatively low density region of the web associated with the deflection conduit portion 230. Pressing the intermediate web 120A on an imprinting fabric 219 having a macroscopically mono-planar, patterned, continuous network web imprinting surface 222, can be provided as a molded web 120B having a macroscopically mono-planar, patterned, continuous network regions having a relatively high density, and a plurality of discrete, relatively low density domes dispersed throughout the continuous, relatively high density network region. Alternatively, a continuous network web imprinting surface 222, can be provided as a molded web 120B having a macroscopically mono-planar, patterned, continuous network regions having a relatively low density, and a plurality of discrete, relatively high density domes dispersed throughout the continuous, relatively low density network region. Further, a continuous network web imprinting surface 222, can be provided as a molded web 120B having macroscopically mono-planar, patterned, continuous network regions having a relatively low density, and continuous network regions having a relatively high density dispersed adjacent the continuous, relatively low density network region. Alternatively, a continuous network web imprinting surface 222, can be provided as a molded web 120B having macroscopically mono-planar, patterned, discrete regions having a relatively low density, and discrete regions having a relatively high density dispersed adjacent the discrete, relatively low density network regions.

A sixth step in the practice of the present invention can comprise pre-drying the molded web 120B, such as with a through-air dryer 400 as shown in FIG. 8. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In addition, without being limited by theory, it is believed that air passing through the portion of the web associated with the deflection conduit portion 230 can further deflect the web into the deflection conduit portion 230, and reduce the density of the relatively low density region, thereby increasing the bulk and apparent softness of the molded web 120B. In one embodiment the molded web 120B can have a consistency of between about 30 and about 65 percent upon entering the through-air dryer 400, and a consistency of between about 40 and about 80 upon exiting the through-air dryer 400.

The through-air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Alternatively, one or more through-air dryers 400 or other suitable drying devices can be located upstream of the nip 300 to partially dry the web prior to pressing the web in the nip 300.

A seventh step in the practice of the present invention can comprise impressing the web imprinting surface of the foraminous imprinting member 219 into the molded web 120B to form an imprinted web 120C. Impressing the web imprinting surface into the molded web 120B serves to further densify, the relatively high density region of the molded web, thereby increasing the difference in density between the regions. Referring to FIG. 8, the molded web 120B is carried on the imprinting member 219 and interposed between the imprinting member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524. "Creped" or "creping" as used herein means creped off of a Yankee dryer or other similar roll and/or fabric creped and/or belt creped. Rush transfer of a fibrous structure alone does not result in a "creped" fibrous structure or "creped" sanitary tissue product for purposes of the present invention.

One of ordinary skill will recognize that the simultaneous imprinting, dewatering, and transfer operations may occur in embodiments other than those using dryer drum such as a Yankee drying drum. For example, two flat surfaces may be juxtaposed to form an elongate nip therebetween. Alternatively, two unheated rolls may be utilized. The rolls may be, for example, part of a calendar stack, or an operation which prints a functional additive onto the surface of the web. Functional additives may include: lotions, emollients, dimethicones, softeners, perfumes, menthols, combinations thereof, and the like.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

Additionally, paper webs produced by the processes described herein can be embossed. "Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, micro-creping, printing or other processes that may also impart a texture and/or decorative pattern to a fibrous structure and/or sanitary tissue product.

If hand sheets are desired, one of skill in the art could utilize the accept pulp was then utilized to form a papermaking slurry. The method of transferring the web is as follows: First, the web is formed on a plastic mesh cloth (84×76-M from Appleton Wire Company, or equivalent). The orientation of the cloth should be so that the sheet is formed on the side with discernible strands in one direction (the other side of the cloth is smooth in both directions). For the present work, a 12 inch by 12 inch deckle box is employed in the tests described herein (although equivalent sizes would also be acceptable). The hand sheet mold is equipped to retain the cloth during sheet forming, and then allow its release with the wet web intact on its surface. Excess water is removed by subjecting the cloth, with the wet web on its surface, to a vacuum of from 3.5 to 4.5 inches of mercury. The vacuum is applied by pulling the cloth across a vacuum slot at a rate of about 1 foot per second. The direction of travel is selected so that the forming cloth is pulled perpendicular to the direction of its discernible strands. The web, so prepared, is transferred onto a 36×30 polyester fabric cloth (e.g., a 36-C from Appleton Wire, or equivalent) by a vacuum of from 9.5 to 10.5 inches of mercury over the vacuum slot. The direction of motion of the web is the same in both vacuum steps, and the 36×30 cloth is used so that the direction having 36 strands is used as the direction of motion.

The wet web and the polyester fabric are dried together on a heated stainless steel dryer drum that is 18 inches wide and 12 inches in diameter. The drum is maintained at a surface temperature of 230° F., and rotated at a speed of from 0.85 to 0.95 revolutions per minute. The wet web and polyester fabric are inserted between the dryer surface and a felt covering the surface and mounted to travel at the same speed as the drum. A felt of ⅛" thickness, style #1044; Commonwealth Felt Company, 136 West Street Northhampton, Mass. 01060 (or equivalent) is employed. The felt is wrapped to cover 63% of the dryer circumference. The wet web is dried in this manner twice with the direction of motion from the transfer step being maintained each time. The first drying step is completed with the fabric next to the dryer surface; the second step with the web next to the surface.

Because this method of hand-sheeting introduces a chance for a slight anisotropy to be created, all testing is performed in both directions with the result averaged to obtain a single value. Further hand-sheets formed by the above described process can be designed to simulate lightweight, low density tissue papers. The hand-sheeting procedure is similar to that described in TAPPI Standard T 205 os-71, except that a lower basis weight is used. In addition, the method of transferring the web from the forming wire and the method of drying the paper are modified. The modifications from the industry standard method are described below. The amount of pulp added is adjusted to result in a conditioned basis weight of 26.9 g/m$^2$.

The fibrous structures and/or sanitary tissue products of the present disclosure may be creped or uncreped. The fibrous structures and/or sanitary tissue products of the present disclosure may be wet-laid or air-laid. The fibrous structures and/or sanitary tissue products of the present disclosure may be embossed. The fibrous structures and/or sanitary tissue products of the present disclosure may comprise a surface softening agent or be void of a surface softening agent. In one example, the sanitary tissue product is a non-lotioned sanitary tissue product. The fibrous structures and/or sanitary tissue products of the present disclosure may comprise trichome fibers and/or may be void of trichome fibers.

EXAMPLE

This example illustrates a non-limiting example of an exemplary method of making improved cellulose pulps which meet the criteria of the present invention by a process consisting essentially of fines removal and hydraulic cyclones. The following example also illustrates a non-limiting example for a preparation of a sanitary tissue product comprising a fibrous structure according to the present invention on a pilot-scale Fourdrinier fibrous structure making (papermaking) machine.

Referring again to FIG. 7A, an aqueous slurry of *eucalyptus* (Brazilian bleached hardwood kraft pulp) feed pulp fibers is treated by a fractionation process incorporating a two-stage system as described supra. A first product stream from the first stage results in an "accept" fiber product that has a lower percentage of vessels than the feed pulp. The second product stream from the first stage results in the product known by one of skill in the art as "reject" product and has a higher percentage of vessels than the feed pulp. The second product stream from the first stage provides the input pulp stream feed to the second stage. The second stage provides a third product stream resulting in additional "accepts" product having a lower percentage of vessels than the initial starting product. This third product stream is re-fed into the first stage. The fourth product stream from the second stage results in the "rejects" product having a higher percentage of vessels than the initial starting product.

In one embodiment, the first stage of a two-stage fractionation process is provided with process settings that provide a pressure drop of about 25.3 psi. The second stage of a two-stage fractionation process is provided with process settings that provide a pressure drop of about 26.5 psi.

In another embodiment, the first stage of a two-stage fractionation process is provided with process settings that provide a pressure drop of about 27.6 psi. The second stage of a two-stage fractionation process is provided with process settings that provide a pressure drop of about 26.5 psi.

Feed pulp was supplied to the hydrocyclone unit at ~3% consistency which was then diluted to 0.5-0.7% and fed to the first hydrocyclone unit. The accept stream from the first hydrocyclone unit had about a 0.4-0.5% consistency. The reject stream from the first hydrocyclone unit was thickened to about 1%. The reject stream from the first hydrocyclone unit was then sent to a second hydrocyclone unit and diluted to 0.4-0.5% consistency. The accept product from the second hydrocyclone unit (having about a 0.4% consistency) was directed to the feed of the first hydrocyclone unit. The rejects from the second hydrocyclone unit were thickened to about a 1% consistency.

In any regard, the accept stream exiting the first stage is recovered and saved and transferred to the papermaking hardwood fiber stock chest. The *eucalyptus* fiber slurry of the hardwood fiber stock chest is pumped through a stock pipe to a hardwood fan pump where the slurry consistency is reduced from about 3% by fiber weight to about 0.15% by fiber weight. The 0.15% *eucalyptus* "accept" slurry was then pumped and distributed in the top chamber of a multi-layered, three-chambered head box of a Fourdrinier wet-laid papermaking machine.

Additionally, a second aqueous slurry of either un-fractionated *Eucalyptus* pulp fibers and/or that portion of the fractionated *Eucalyptus* pulp fibers from the "reject" stream is prepared at about 3% fiber by weight using a conventional re-pulper, then transferred to a reject fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% un-fractionated or "reject" *eucalyptus* slurry is then directed and distributed to the center chamber of a multi-layered, three-chambered head box of a Fourdrinier wet-laid papermaking machine.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The wet-laid papermaking machine has a layered head box having a top chamber, a center chamber, and a bottom chamber where the chambers feed directly onto the forming wire (Fourdrinier wire). The *eucalyptus* fiber slurry of 0.15% consistency is directed to the top head box chamber and bottom head box chamber. The NSK fiber slurry is directed to the center head box chamber. All three fiber layers are delivered simultaneously in superposed relation onto the Fourdrinier wire to form thereon a three-layer embryonic fibrous structure (web), of which about 33% of the top side is made up of the *eucalyptus* fibers, about 33% is made of the *eucalyptus* fibers on the bottom side and about 34% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 800 feet per minute (fpm).

The embryonic wet fibrous structure is transferred from the Fourdrinier wire, at a fiber consistency of about 16-20% at the point of transfer, to a 3D patterned through-air-drying belt. The speed of the 3D patterned through-air-drying belt is the same as the speed of the Fourdrinier wire. The 3D patterned through-air-drying belt is designed to yield a fibrous structure comprising a pattern of semi-continuous low density pillow regions and semi-continuous high density knuckle regions. This 3D patterned through-air-drying belt is formed by casting an impervious resin surface onto a fiber mesh supporting fabric. The supporting fabric is a 98×52 filament, dual layer fine mesh. The thickness of the resin cast is about 13 mils above the supporting fabric.

Further de-watering of the fibrous structure is accomplished by vacuum assisted drainage until the fibrous structure has a fiber consistency of about 20% to 30%. While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Solenis (formerly Hercules Incorporated of Wilmington, Del.). The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 810. The Yankee dryer is operated at a temperature of about 275° F. and a speed of about 800 fpm. The fibrous structure is wound in a roll (parent roll) using a surface driven reel drum having a surface speed of about 695 fpm.

Two parent rolls of the fibrous structure can then converted into a sanitary tissue product by loading the roll of fibrous structure into an unwind stand at a line speed of 400 ft/min. One parent roll of the fibrous structure can be unwound and transported to an embossing process where the fibrous structure can be strained to form an emboss pattern in the fibrous structure. This embossed ply can then be combined with an embossed or un-embossed fibrous structure from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the inventive properties shown in the tables provided infra.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to testing. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

1. Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example:

Basis Weight (lbs/3000 $ft^2$)=[[Mass of stack (g)/453.6 (g/lbs)]/[12.25 ($in^2$)/144 ($in^2/ft^2$)×12]]×3000 or,

Basis Weight ($g/m^2$)=Mass of stack (g)/[79.032 ($cm^2$)/10,000 ($cm^2/m^2$)×12].

Report the numerical result to the nearest 0.1 lbs/3000 $ft^2$ or 0.1 $g/m^2$. Sample dimensions can be changed or varied using a similar precision cutter as mentioned above, so as at least 100 square inches of sample area in stack.

2. Caliper Test Method

Caliper of a fibrous structure and/or sanitary tissue product is measured using a ProGage Thickness Tester (Thwing-Albert Instrument Company, West Berlin, N.J.) with a pressure foot diameter of 2.00 inches (area of 3.14 $in^2$) at a pressure of 95 $g/in^2$. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 $g/in^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

3. Pulp Fiber and Vessel Measurement Method (Fiber Quality Analysis)

Pulp fiber and vessel measurements are obtained using the Fiber Quality Analyzer (FQA) instrument (OpTest Equipment Inc., Ontario, Canada) running the FQA software including the vessel analysis capability. The FQA is a fully integrated patented flow cell system with optics, control and measurement electronics, and pneumatic and liquid systems. This instrument rapidly, accurately and automatically measures the quality of a disintegrated pulp sample dispersed in water. The qualities measured by the instrument include fiber length (true contour length), fiber width, coarseness, fiber curl, fiber kink, and % fines. Additionally, the instrument detects and measures the number of vessel elements counted, the mean vessel area, mean vessel effective length and width, and the number of vessel elements per meter of fiber. The sample preparation, instrument operation and testing procedures are performed according the instrument manufacture's specifications.

Sample Preparation

According to the instrument manufacturer's instruction, obtain a dry pulp sample from a sheet, disintegrate and disperse the sample in water, then dilute the sample to the necessary testing conditions. The aim is to dilute the pulp sample to achieve a target fiber frequency of events per second (EPS) during the test, which will vary depending on the type of pulp (hardwood or softwood) being analyzed.

Testing Procedure

Perform the fiber and vessel analysis test on the prepared pulp sample according to the instrument manufacturer's specifications using default test limit settings where optional. For vessel identification and analysis by the FQA, use a minimum vessel element width setting of 100 am and length setting of 0.10 mm. Due to the low frequency of vessel elements in most pulp samples, test a sufficient volume of pulp sample to measure enough vessel elements for the vessel element results to be statistically significant. Report and record the pulp fiber measurement results for the pulp sample to the appropriate significant figures. These include the fiber length (true contour length), fiber width, coarseness, fiber curl, fiber kink, and % fines. Additionally, report and record the vessel measurement results for the pulp sample to the appropriate significant figures. These include the number of vessel elements counted, the mean vessel area, mean vessel effective length and width, and the number of vessel elements per meter of fiber.

4. Tensile Test Method: Elongation, Tensile Strength, TEA and Modulus

For the purposes of determining, calculating, and reporting 'wet burst', 'total dry tensile', and 'dynamic coefficient of friction' values infra, a unit of 'user units' is hereby utilized for the products subject to the respective test method. As would be known to those of skill in the art, bath tissue and paper toweling are typically provided in a perforated roll format where the perforations are capable of separating the tissue or towel product into individual units. A 'user unit' (uu) is the typical finished product unit that a consumer would utilize in the normal course of use of that product. A single-, double, or even triple-ply finished product that a consumer would normally use would have a value of one user unit (uu). For example, facial tissues that are not normally provided in a roll format, but as a stacked plurality of discreet tissues, a facial tissue having one ply would have a value of 1 user unit (uu). An individual two-ply facial tissue product would have a value of one user unit (1 uu), etc.

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the cell. Both the movable (upper) and stationary (lower) pneumatic jaws are fitted with smooth stainless steel faced grips, 25.4 mm in height and wider than the width of the test specimen. An air pressure of about 60 psi is supplied to the jaws.

Eight usable units of fibrous structure are divided into two stacks of four samples each. The samples in each stack are consistently oriented with respect to machine direction (MD) and cross direction (CD). One of the stacks is designated for testing in the MD and the other for CD. Using a one inch precision cutter (Thwing Albert JDC-1-10, or similar) cut 4 MD strips from one stack, and 4 CD strips from the other, with dimensions of 1.00 in±0.01 in wide by 3.0-4.0 in long. Each strip of one usable unit thick will be treated as a unitary specimen for testing.

Program the tensile tester to perform an extension test, collecting force and extension data at an acquisition rate of 20 Hz as the crosshead raises at a rate of 2.00 in/min (5.08 cm/min) until the specimen breaks. The break sensitivity is set to 80%, i.e., the test is terminated when the measured force drops to 20% of the maximum peak force, after which the crosshead is returned to its original position.

Set the gauge length to 1.00 inch. Zero the crosshead and load cell. Insert at least 1.0 in of the unitary specimen into the upper grip, aligning it vertically within the upper and lower jaws and close the upper grips. Insert the unitary specimen into the lower grips and close. The unitary specimen should be under enough tension to eliminate any slack, but less than 5.0 g of force on the load cell. Start the tensile tester and data collection. Repeat testing in like fashion for all four CD and four MD unitary specimens.

Program the software to calculate the following from the constructed force (g) verses extension (in) curve:

Tensile Strength is the maximum peak force (g) divided by the sample width (in) and reported as g/in to the nearest 1 g/in.

Adjusted Gauge Length is calculated as the extension measured at 3.0 g of force (in) added to the original gauge length (in).

Elongation is calculated as the extension at maximum peak force (in) divided by the Adjusted Gauge Length (in) multiplied by 100 and reported as % to the nearest 0.1%.

Total Energy (TEA) is calculated as the area under the force curve integrated from zero extension to the extension at the maximum peak force (g*in), divided by the product of the adjusted Gauge Length (in) and specimen width (in) and is reported out to the nearest 1 g*in/in$^2$.

Replot the force (g) verses extension (in) curve as a force (g) verses strain curve. Strain is herein defined as the extension (in) divided by the Adjusted Gauge Length (in).

Program the software to calculate the following from the constructed force (g) verses strain curve:

Tangent Modulus is calculated as the slope of the linear line drawn between the two data points on the force (g) versus strain curve, where one of the data points used is the first data point recorded after 28 g force, and the other data point used is the first data point recorded after 48 g force. This slope is then divided by the specimen width (2.54 cm) and reported to the nearest 1 g/cm.

The Tensile Strength (g/in), Elongation (%), Total Energy (g*in/in$^2$) and Tangent Modulus (g/cm) are calculated for the four CD unitary specimens and the four MD unitary specimens. Calculate an average for each parameter separately for the CD and MD specimens.

Calculations:

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA (g*in/in$^2$)×CD TEA (g*in/in$^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA (g*in/in$^2$)+CD TEA (g*in/in$^2$)

Total Modulus=MD Modulus (g/cm)+CD Modulus (g/cm)

Tensile Ratio=MD Tensile Strength (g/in)/CD Tensile Strength (g/in)

5. Initial Total Wet Tensile Test Method

The initial total wet tensile of a dry fibrous structure is determined using a Thwing-Albert EJA Material Tester Instrument, Cat. No. 1350, equipped with 5000 g load cell available from Thwing-Albert Instrument Company, 14 Collings Ave. W. Berlin, N.J. 08091. 10% of the 5000 g load cell is utilized for the initial total wet tensile test.

i. Sample Preparation—A sample strip of dry fibrous structure to be tested [2.54 cm (1 inch) wide by greater than 5.08 cm (2 inches)] long is obtained.

ii. Operation—The test settings for the instrument are:
Crosshead speed—10.16 cm/minute (4.0 inches/minute)
Initial gauge length 2.54 cm (1.0 inch)
Adjust the load cell to read zero plus or minus 0.5 grams$_{force}$ ($g_f$)

iii. Testing Samples—One end of the sample strip is placed between the upper jaws of the machine and clamped. After verifying that the sample strip is hanging straight between the lower jaws, clamp the other end of the sample strip in the lower jaws.

a. Pre-Test—Strain the sample strip to 25 grams$_{force}$ (+/−10 grams$_{force}$) at a strain rate of 3.38 cm/minute (1.33 inches/minute) prior to wetting the sample strip. The distance between the upper and lower jaws is now greater than 2.54 cm (1.0 inch). This distance now becomes the new zerostrain position for the forthcoming wet test described below.

b. Wet Test—While the sample strip is still at 25 grams$_{force}$ (+/−10 grams$_{force}$), it is wetted, starting near the upper jaws, a water/0.1% Pegosperse® ML200 (available from Lonza Inc. of Allendale, N.J.) solution [having a temperature of about 73° F.±4° F. (about 23° C.±2.2° C.)] is delivered to the sample strip via a 2 mL disposable pipette. Do not contact the sample strip with the pipette and do not damage the sample strip by using excessive squirting pressure. The solution is continuously added until the sample strip is visually determined to be completely saturated between the upper and lower jaws. At this point, the load cell is re-adjusted to read 0±0.5 grams$_{force}$. The sample strip is then strained at a rate of 10.16 cm/minute (4 inches/minute) and continues until the sample strip is strained past its failure point (failure point being defined as the point on the force-strain curve where the sample strip falls to 50% of its peak strength after it has been strained past its peak strength). The straining of the sample strip is initiated between 5-10 seconds after the sample is initially wetted. The initial result of the test is an array of data points in the form of load (grams$_{force}$) versus strain (where strain is calculated as the crosshead displacement (cm of jaw movement from starting point) divided by the initial separation distance (cm) between the upper and lower jaws after the pre-test.

The sample is tested in two orientations, referred to here as MD (machine direction, i.e., in the same direction as the continuously wound reel and forming fabric) and CD (cross-machine direction, i.e., 90° from MD). The MD and CD initial wet tensile strengths are determined using the above equipment and the initial total wet tensile values are calculated in the following manner:

$$\text{ITWT (g/inch)} = \text{Peak Load}_{MD}\ (g_f)/1\ (\text{inch}_{width}) + \text{Peak Load}_{CD}\ (g_f)/1\ (\text{inch}_{width})$$

6. Vertical Full Sheet (VFS) Test Method

The Vertical Full Sheet (VFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a vertical position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the VFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor bench-top weighing. The balance should also have a special balance pan to be able to handle the size of the sample tested (i.e.; a fibrous structure sample of about 11 in. (27.9 cm) by 11 in. (27.9 cm)). The balance pan can be made out of a variety of materials. Plexiglass is a common material used.

2) A sample support rack and sample support rack cover is also required. Both the rack and cover are comprised of a lightweight metal frame, strung with 0.012 in. (0.305 cm) diameter monofilament so as to form a grid. The size of the support rack and cover is such that the sample size can be conveniently placed between the two.

The VFS test is performed in an environment maintained at 23±1° C. and 50±2% relative humidity. A water reservoir or tub is filled with distilled water at 23±10 C to a depth of 3 inches (7.6 cm).

Eight 19.05 cm (7.5 inch)×19.05 cm (7.5 inch) to 27.94 cm (11 inch)×27.94 cm (11 inch) samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain vertically for 60±5 seconds, taking care not to excessively shake or vibrate the sample. While the sample is draining, the rack cover is carefully removed and all excess water is wiped from the support rack. The wet sample and the support rack are weighed on the previously tared balance. The weight is recorded to the nearest 0.01 g. This is the wet weight of the sample.

The procedure is repeated for with another sample of the fibrous structure, however, the sample is positioned on the support rack such that the sample is rotated 90° compared to the position of the first sample on the support rack. The gram per fibrous structure sample absorptive capacity of the sample is defined as (wet weight of the sample—dry weight of the sample). The calculated VFS is the average of the absorptive capacities of the two samples of the fibrous structure.

7. Capacity Rate Test

Conditioned Room-Temperature is controlled from 73° F.±2° F. (23° C.±1° C.). Relative Humidity is controlled from 50%±2%

Sample Preparation-Product samples are cut using hydraulic/pneumatic precision cutter into 3.375 inch diameter circles.

Capacity Rate Tester (CRT)—The CRT is an absorbency tester capable of measuring capacity and rate. The CRT consists of a balance (0.001 g), on which rests on a woven grid (using nylon monofilament line having a 0.014" diameter) placed over a small reservoir with a delivery tube in the center. This reservoir is filled by the action of solenoid valves, which help to connect the sample supply reservoir to an intermediate reservoir, the water level of which is monitored by an optical sensor. The CRT is run with a −2 mm water column, controlled by adjusting the height of water in the supply reservoir.

Software—LabView based custom software specific to CRT Version 4.2 or later.

Water—Distilled water with conductivity <100/cm (target <5 pS/cm) @ 25° C.

Sample Preparation—For this method, a usable unit is described as one finished product unit regardless of the number of plies. Condition all samples with packaging materials removed for a minimum of 2 hours prior to testing. Discard at least the first ten usable units from the roll. Remove two usable units and cut one 3.0-inch circular sample from the center of each usable unit for a total of 2 replicates for each test result. Do not test samples with defects such as wrinkles, tears, holes, etc. Replace with another usable unit which is free of such defects.

Sample Testing Pre-Test Set-Up

1. The water height in the reservoir tank is set −2.0 mm below the top of the support rack (where the towel sample will be placed).

2. The supply tube (8 mm I.D.) is centered with respect to the support net.

3. Test samples are cut into circles of 3" diameter and equilibrated at Tappi environment conditions for a minimum of 2 hours.

Test Description

1. After pressing the start button on the software application, the supply tube moves to 0.33 mm below the water height in the reserve tank. This creates a small meniscus of water above the supply tube to ensure test initiation. A valve between the tank and the supply tube closes, and the scale is zeroed.

2. The software prompts you to "load a sample". A sample is placed on the support net, centering it over the supply tube, and with the side facing the outside of the roll placed downward.

3. Close the balance windows, and press the "OK" button—the software records the dry weight of the sample.

4. The software prompts you to "place cover on sample". The plastic cover is placed on top of the sample, on top of the support net. The plastic cover has a center pin (which is flush with the outside rim) to ensure that the sample is in the proper position to establish hydraulic connection. Optionally, four other pins, 1 mm shorter in depth, are positioned 1.25-1.5 inches radially away from the center pin to ensure the sample is flat during the test. The sample cover rim should not contact the sheet. Close the top balance window and click "OK".

5. The software re-zeroes the scale and then moves the supply tube towards the sample. When the supply tube reaches its destination, which is 0.33 mm below the support net, the valve opens (i.e., the valve between the reserve tank and the supply tube), and hydraulic connection is established between the supply tube and the sample. Data acquisition occurs at a rate of 5 Hz, and is started about 0.4 seconds before water contacts the sample.

6. The test runs until the instrument measures the rate of uptake to be less than 1.5 mg/sec. Specifically, the instrument keeps a running tally of the amount of fluid taken up by the sample. When the amount of fluid taken up over the last 6 seconds is less than 9 mg, the test terminates. The supply tube pulls away from the sample to break the hydraulic connection.

7. The software records the weight on the scale. This weight represents only the amount of water taken up by the sample.

8. The wet sample is removed from the support net. Residual water on the support net and cover are dried with a paper towel.

9. Repeat until all samples are tested.

10. After each test is run, a *.txt file is created (typically stored in the CRT/data/rate directory) with a file name as typed at the start of the test. The file contains all the test set-up parameters, dry sample weight, and cumulative water absorbed (g) vs. time (sec) data collected from the test.

The CRT value is calculated by dividing the weight of water absorbed (as recorded at the end of the test) by the weight of the dry sample taken in step 3. The units of CRT value are g/g.

8. Lint Test Method i. Sample Preparation—Sample strips (a total of 4 if testing both sides, 2 if testing a single side) of fibrous structures and/or sanitary tissue products, which do not have abraded portions) 11.43 cm (4.5 inch) wide×30.48 cm to 40.64 cm (12-16 inch) long such that each sample strip can be folded upon itself to form a 11.43 cm (4.5 inch) wide (CD) by 10.16 cm (4.0 inch) long (MD) rectangular implement having a total basis weight of between 140 to 200 g/m$^2$ are obtained and conditioned according to Tappi Method #T402OM-88. For both side testing, makeup two rectangular implements as described above with a first side out and then two rectangular implements with the other side out (keep track of which are which).

For sanitary tissue products formed from multiple plies of fibrous structure, this test can be used to make a lint measurement on the multi-ply sanitary tissue product, or, if the plies can be separated without damaging the sanitary tissue product, a measurement can be taken on the individual plies making up the sanitary tissue product. If a given sample differs from surface to surface, it is necessary to test both surfaces and average the scores in order to arrive at a composite lint score. In some cases, sanitary tissue products are made from multiple-plies of fibrous structures such that the facing-out surfaces are identical, in which case it is only necessary to test one surface.

Each sample is folded upon itself to make a 4.5" CD×4" MD sample. For two-surface testing, make up 3 (4.5" CD×4" MD) samples with a first surface "out" and 3 (4.5" CD×4" MD) samples with the second surface "out". Keep track of which samples are first surface "out" and which are second surface "out".

For a dry lint test, obtain a 30"×40" piece of Crescent #300 cardboard from Cordage Inc. (800 E. Ross Road, Cincinnati, Ohio, 45217) or equivalent. Using a paper cutter, six pieces of cardboard of dimensions of 6.35 cm×15.24 cm (2.5 inch×6 inch) are cut. Puncture two holes into each of the six pieces of cardboard by forcing the cardboard onto the hold down pins of the Sutherland Rub tester. Center and carefully place each of the cardboard pieces on top of the previously folded samples with the tested side exposed outward. Make sure the 15.24 cm (6 inch) dimension of the cardboard is running parallel to the machine direction (MD) of each of the folded samples. Fold one edge of the exposed portion of the sample onto the back of the cardboard. Secure this edge to the cardboard with adhesive tape obtained from 3M Inc. (¾" wide Scotch Brand, St. Paul, Minn.) or equivalent. Carefully grasp the other over-hanging tissue edge and snugly fold it over onto the back of the cardboard. While maintaining a snug fit of the sample onto the cardboard, tape this second edge to the back of the cardboard. Repeat this procedure for each sample. Turn over each sample and tape the cross direction edges of the sample to the cardboard. One half of the adhesive tape should contact the sample while the other half is adhering to the cardboard. Repeat this procedure for each of the samples. If the sample breaks, tears, or becomes frayed at any time during the course of this sample preparation procedure, discard and make up a new sample with a sample strip.

ii. Felt and Weight Component Preparation—Cut a piece of a black test felt (F-55 or equivalent from New England Gasket, 550 Broad Street, Bristol, Conn. 06010) to the dimensions of 2¼"×7¼". The felt is to be used in association with a weight. The weight may include a clamping device to attach the felt/cardboard combination to the weight. The weight and any clamping device total five (5) pounds. The weight is available from Danilee Company, San Antonio, Tex., and is associated with the Sutherland Rub Tester. The weight has a 2"×4" piece of smooth surface foam attached to its contact face (⅛" thick, Poron quick Recovery Foam, adhesive back, firmness rating 13). For the dry test, the felt is clamped directly against this foam surface, providing an effective contact area of 8 in$^2$ and a contact pressure of about 0.625 psi. For the wet test, an additional 1"×4" foam strip (same foam as described above) is attached and centered in the length direction on top the 2"×4" foam strip, thus, after clamping the felt against this surface, an effective contact area of 4 in$^2$ and a contact pressure of about 1.25 psi is established. Also, for the wet test only, after clamping the felt to weight apparatus, two strips of tape (4¼"-5¼" in length, Scotch brand ¾" width) are placed along each edge of the felt (parallel to the long side of the felt) on the felt side that will be contacting the sample. The untaped felt between the two tape strips has a width between 18-21 mm. Three marks are placed on one of the strips of tape at 0, 4 and 10 centimeters along the flat, test region of the test felt.

iii. Conducting Dry Lint Test—The amount of dry lint and/or dry pills generated from a fibrous product according to the present invention is determined with a Sutherland Rub Tester (available from Danilee Company, San Antonio, Tex.). This tester uses a motor to rub a felt/weight component 5 times (back and forth) over the fibrous product, while the fibrous product is restrained in a stationary position.

First, turn on the Sutherland Rub Tester pressing the "reset" button. Set the tester to run 5 strokes at the lower of the two speeds. One stroke is a single and complete forward and reverse motion of the weight. The end of the rubbing block should be in the position closest to the operator at the beginning and at the end of each test.

Place the sample/cardboard combination on the base plate of the tester by slipping the holes in the board over the hold-down pins. The hold-down pins prevent the sample from moving during the test. Hook the felt/weight combination into the tester arm of the Sutherland Rub Tester, and gently place it on top of the sample/cardboard combination. The felt must rest level on the calibration sample and must be in 100% contact with the calibration sample surface (use a bubble level indicator to verify). Activate the Sutherland Rub Tester by pressing the "start" button.

Keep a count of the number of strokes and observe and make a mental note of the starting and stopping position of the felt covered weight in relationship to the sample. If the total number of strokes is five and if the position of the calibration felt covered weight is the same at the end as it was in the beginning of the test, the test was successful performed. If the total number of strokes is not five or if the start and end positions of the felt covered weight are different, then the instrument may require servicing and/or recalibration.

Once the instrument is finished moving, remove the felt covered weight from the holding arm of the instrument, and unclamp the felt from the weight. Lay the test felt on a clean, flat surface.

The next step is to complete image capture, analysis, and calculations on the test felts as described below.

vi. Image Capture—The images of the felt (untested), sample (untested) and felt (tested) are captured using a computer and scanner (Microtek ArtixScan 1800f). Be certain that scanner glass is clear and clean. Place felts centered on scanner, face down. Adjust image capture boundaries so that all felts are included into the captured image. Set-up the scanner to 600 dpi, RGB, and 100% image size (no scaling). After successfully imaging the felts, save the image as an 8-bit RGB TIFF image, remove felts from scanner, and repeat from process until all felts images are captured.

Additional images of the sample (untested) may need to be captured (in the same manner) if they have an average luminance (using Optimas software) significantly less than 254 (less than 244), after being converted to an 8-bit gray-scale image. Also, an image of a known length standard (e.g., a ruler) is taken (exposure difference does not matter for this image). This image is used to calibrate the image analysis software distance scale.

vii. Image Analysis—The images captured are analyzed using Optimas 6.5 Image Analysis software commercially available from Media Cybernetics, L.P. Imaging set-up parameters, as listed herein, must be strictly adhered to in order to have meaningfully comparative lint score and pill score results.

First, an image with a known length standard (e.g., a ruler) is brought up in Optimas, and used to calibrate length units (millimeters in this case). For dry testing, the region of interest (ROI) area is approximately 4500 mm2 (90 mm by 50 mm), and the wetted and dragged ROI area is approximately 1500 mm2 (94 mm by 16 mm). The exact ROI area is measured and recorded (variable name: ROI area). The average gray value of the un-rubbed region of the test felt is used as the baseline, and is recorded for determining the threshold and lint values (variable name: untested felt GV avg). It is determined by creating a region of interest box (ROI) with dimensions approximately 5 mm by 25 mm on the untested, unrubbed area of the black felt, on opposite ends of the rubbed region. The average of these two average gray value luminaces for each of the ROI's is used as the untested felt GV average value for that particular test felt. This is repeated for all test felts analyzed. The test sheet luminance is typically near saturated white (gray value 254) and fairly constant for samples of interest. If believed to be different, measure the test sheet in a similar fashion as was done for the untested felt, and record (variable name=untested sheet GV avg). The luminance threshold is calculated based on the untested felt GV avg and untested sheet GV avg as follows:

For the dry lint/pilling test felts:

(untested_sheet_GV_avg−untested_felt_GV_avg)*0.4+untested_felt_GV_avg

For the wet lint/pilling test felts:

(untested_sheet_GV_avg−untested_felt_GV_avg)*0.25+untested_felt_GV_avg

The test felt image is opened, and the ROI and its boundaries are created and properly positioned to encompass a region that completely contains pills and contains the highest concentration of pills on the rubbed section of the test felt. The average luminance for the ROI is recorded (variable name: ROI GV avg). Pills are determined as follows: Optimas creates boundary lines in the image where pixel luminance values cross through the threshold value (e.g., if the threshold is 120, boundary lines are created where pixels of higher and lower value exist on either side. The criteria for determining a pill is that it must have an average luminance greater than the threshold value, and have a perimeter length greater than 0.5 mm. The sum of the pilled areas variable name is: Total Pilled Area.

Measurement data of the ROI, and for each pill is exported from Optimas to a spreadsheet for performing the following calculations.

viii. Calculations—The data obtained from the image analysis is used in the following calculations:

Pilled Area %=Percent of area covered by pilling=Total Pilled Area/ROI area

Lint Score=Gray value difference between un-pilled area of the rubbed test felt area and the untested felt Lint Score=un-pilled felt Gray Value avg−untested felt Gray Value avg where:

un-pilled felt Gray Value avg=[(ROI Gray Value avg*ROI area)−(pilled Gray Value avg*pilled area)]/Total Un-pilled Area By taking the average of the lint score of the first-side surface and the second-side surface, the lint is obtained which is applicable to that particular web or product. In other words, to calculate lint score, the following formula is used:

$$\text{Dry Lint Score} = \frac{\text{Dry Lint Score, } 1^{st} \text{ side} + \text{Dry Lint Score, } 2^{nd} \text{ side}}{2}$$

$$\text{Dry Pill Area \%} = \frac{\text{Dry Pill Area \%, } 1^{st} \text{ side} + \text{Dry Pill Area \%, } 2^{nd} \text{ side}}{2}$$

9. Emtec TSA Test Method

TS7 and TS750 values are measured using an EMTEC Tissue Softness Analyzer ("Emtec TSA") (Emtec Electronic GmbH, Leipzig, Germany) interfaced with a computer running Emtec TSA software (version 3.19 or equivalent). According to Emtec, the TS7 value correlates with the real material softness, while the TS750 value correlates with the felt smoothness/roughness of the material. The Emtec TSA comprises a rotor with vertical blades which rotate on the test sample at a defined and calibrated rotational speed (set by manufacturer) and contact force of 100 mN. Contact between the vertical blades and the test piece creates vibrations, which create sound that is recorded by a microphone within the instrument. The recorded sound file is then analyzed by the Emtec TSA software. The sample preparation, instrument operation and testing procedures are performed according the instrument manufacture's specifications.

Sample Preparation

Test samples are prepared by cutting square or circular samples from a finished product.

Test samples are cut to a length and width (or diameter if circular) of no less than about 90 mm, and no greater than about 120 mm, in any of these dimensions, to ensure the sample can be clamped into the TSA instrument properly. Test samples are selected to avoid perforations, creases or folds within the testing region. Prepare 8 substantially similar replicate samples for testing. Equilibrate all samples at TAPPI standard temperature and relative humidity conditions (23° C.±2 C° and 50%±2%) for at least 1 hour prior to conducting the TSA testing, which is also conducted under TAPPI conditions.

Testing Procedure

Calibrate the instrument according to the manufacturer's instructions using the 1-point calibration method on Emtec reference 2X (nn.n) samples. If these reference samples are no longer available, use the appropriate reference samples provided by the manufacturer. Calibrate the instrument according to the manufacturer's recommendation and instruction, so that the results will be comparable to those obtained when using the 1-point calibration method on Emtec reference 2X (nn.n) samples.

Mount the test sample into the instrument, and perform the test according to the manufacturer's instructions. When complete, the software displays values for TS7 and TS750. Record each of these values to the nearest 0.01 dB $V^2$ rms. The test piece is then removed from the instrument and discarded. This testing is performed individually on the top surface (outer facing surface of a rolled product) of four of the replicate samples, and on the bottom surface (inner facing surface of a rolled product) of the other four replicate samples.

The four test result values for TS7 and TS750 from the top surface are averaged (using a simple numerical average); the same is done for the four test result values for TS7 and TS750 from the bottom surface. Report the individual average values of TS7 and TS750 for both the top and bottom surfaces on a particular test sample to the nearest 0.01 dB $V^2$ rms. Additionally, average together all eight test value results for TS7 and TS750, and report the overall average values for TS7 and TS750 on a particular test sample to the nearest 0.01 dB $V^2$ rms.

10. Flexural Rigidity Test Method

This test is performed on 1 inch×6 inch (2.54 cm×15.24 cm) strips of a fibrous structure sample. A Cantilever Bending Tester such as described in ASTM Standard D 1388 (Model 5010, Instrument Marketing Services, Fairfield, N.J.) is used and operated at a ramp angle of 41.5±0.5° and a sample slide speed of 0.5±0.2 in/second (1.3±0.5 cm/second). A minimum of n=16 tests are performed on each sample from n=8 sample strips.

No fibrous structure sample which is creased, bent, folded, perforated, or in any other way weakened should ever be tested using this test. A non-creased, non-bent, non-folded, non-perforated, and non-weakened in any other way fibrous structure sample should be used for testing under this test.

From one fibrous structure sample of about 4 inch×6 inch (10.16 cm×15.24 cm), carefully cut using a 1 inch (2.54 cm) JDC Cutter (available from Thwing-Albert Instrument Company, Philadelphia, Pa.) four (4) 1 inch (2.54 cm) wide by 6 inch (15.24 cm) long strips of the fibrous structure in the MD direction. From a second fibrous structure sample from the same sample set, carefully cut four (4) 1 inch (2.54 cm) wide by 6 inch (15.24 cm) long strips of the fibrous structure in the CD direction. It is important that the cut be exactly perpendicular to the long dimension of the strip. In cutting non-laminated two-ply fibrous structure strips, the strips should be cut individually. The strip should also be free of wrinkles or excessive mechanical manipulation which can impact flexibility. Mark the direction very lightly on one end of the strip, keeping the same surface of the sample up for all strips. Later, the strips will be turned over for testing, thus it is important that one surface of the strip be clearly identified, however, it makes no difference which surface of the sample is designated as the upper surface.

Using other portions of the fibrous structure (not the cut strips), determine the basis weight of the fibrous structure sample in lbs/3000 $ft^2$ and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Place one of the strips on the horizontal platform using care to align the strip parallel with the movable sample slide. Align the strip exactly even with the vertical edge of the Tester wherein the angular ramp is attached or where the zero mark line is scribed on the Tester. Carefully place the sample slide bar back on top of the sample strip in the Tester. The sample slide bar must be carefully placed so that the strip is not wrinkled or moved from its initial position.

Move the strip and movable sample slide at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average overhang length is determined by averaging the sixteen (16) readings obtained on a fibrous structure.

$$\text{Overhang Length } MD = \frac{\text{Sum of 8 } MD \text{ readings}}{8}$$

$$\text{Overhang Length } CD = \frac{\text{Sum of 8 } CD \text{ readings}}{8}$$

$$\text{Overhang Length Total} = \frac{\text{Sum of 16 readings}}{16}$$

$$\text{Bend Length } MD = \frac{\text{Overhang Length } MD}{2}$$

$$\text{Bend Length } CD = \frac{\text{Overhang Length } CD}{2}$$

$$\text{Bend Length Total} = \frac{\text{Overhang Length Total}}{2}$$

$$\text{Flexural Rigidity} = 0.1629 \times W \times C^3$$

wherein W is the basis weight of the fibrous structure in lbs/3000 $ft^2$; C is the bending length (MD or CD or Total) in cm; and the constant 0.1629 is used to convert the basis weight from English to metric units. The results are expressed in mg-cm.

GM Flexural Rigidity=Square root of (MD Flexural Rigidity×CD Flexural Rigidity)

11. Dry Burst

Dry burst strength is measured using a Thwing-Albert Intelect II STD Burst Tester. 8 uu of tissue are stacked in four groups of 2 uu. Using scissors, cut the samples so that they are approximately 208 mm in the machine direction and approximately 114 mm in the cross-machine direction, each 2 uu thick.

Take one sample strip and place the dry sample on the lower ring of the sample holding device with the outer surface of the product facing up, so that the sample completely covers the open surface of the sample holding ring. If wrinkles are present, discard the sample and repeat with a new sample. After the sample is properly in place on the lower ring, turn the switch that lowers the upper ring. The sample to be tested is now securely gripped in the sample holding unit. Start the burst test immediately at this point by pressing the start button. The plunger will begin to rise. At the point when the sample tears or ruptures, report the maximum reading. The plunger will automatically reverse and return to its original starting position. Repeat this procedure on three more samples for a total of four tests, i.e., 4 replicates. Average the four replicates and divide this average by two to report dry burst per uu, to the nearest gram.

12. Wet Burst Test Method

The wet burst strength of fibrous structures and sanitary tissue products comprising fibrous structures (collectively referred to as "sample" or "samples" within this test method) is determined using an electronic burst tester and specified test conditions. The results obtained are averaged and the wet burst strength is reported. Provisions are made for testing rapid-aged samples as well as fresh or naturally aged samples.

Apparatus: Burst Tester—Refer to manufacturer's operation and set-up instructions.

Note: Thwing-Albert Wet Burst Testers with an upward force measurement yields values approximately 3-7 grams higher than testers with a downward force measurement. This is due to the weight of the wetted product resting on the load cell. Therefore, the downward movement is preferred. When comparing data, the instrument used should be noted.

Calibration Weights—Refer to manufacturer's Calibration instructions

Paper Cutter—Cutting board, 24 in. (600 mm) size

Scissors—4 in. (100 mm), or larger

Pan—Approximate Width/Length/Depth: 9 in.×12 in.×2 in. (240×300×50 mm), or equivalent Oven Forced draft, 221° F.±2° F. (105° C.±1° C.) with wire shelves. Blue M or equivalent Clamp (For use in rapid aging samples) Day Pinchcock, Fisher Cat. No. 05-867, or equivalent Re-sealable plastic bags—Size 26.8 cm×27.9 cm Distilled water at the temperature of the conditioned room used.

Sample Preparation

For this method, a usable unit is described as one sanitary tissue product unit regardless of the number of plies.

1-Ply Bath Tissue: If beginning a new tissue roll the first 15 sample sheets have to be removed (to remove Tail-Release-Gluing). Roll off 16 strips of product each 3 sample sheets in length. It is important that the center sample sheet in each three sample sheet strips not be stretched or wrinkled since it is the unit to be tested. Ensure that sheet perforations are not in the area to be tested. Stack the 3 sample sheet strips 4 high, 4 times to form your test samples.

2-Ply/3-Ply/4-Ply Bath Tissue: If beginning a new tissue roll, the first 15 sample sheets have to be removed (to remove Tail-Release-Gluing). Roll off 8 strips of product each, 3 sample sheets in length, It is important the center sample sheet in each three sample sheet strip not be stretched or wrinkled since it is the sample sheet to be tested. Ensure that sheet perforations are not in the area to be tested. Stack the 3 sample sheet strips 2 high, 4 times to form your test samples.

Fresh or Naturally Aged Samples: Test prepared samples as described under Operation. Results on freshly produced paper and the same paper after aging for some period of time will frequently differ.

Rapid Aging: Rapid aging of samples results in answers which are more indicative of sample performance after aging in a warehouse, during shipping, or in the marketplace. When required, rapid age samples by one of the following methods, selecting the method that is sufficient to fully age the product, this can be established via sample aging profiles.

5-Minute Rapid Aging: Attach a small paper clip or clamp at the center of one of the narrow edges (perforated edge for sample; 6 in. (152.4 mm) for unconverted stock) of each sample stack: 1-ply toilet tissue 16 sheets thick and 2-ply/3-ply/4-ply toilet tissue eight sheets thick, a sample stack for reel samples is eight plies thick. Suspend each sample stack by a clamp in a 221° F.±2° F. (105° C.±1° C.) forced draft oven for a period of five minutes±10 seconds at temperature. Remove the sample stack from the oven and cool for a minimum of 3 minutes before testing. Test the sample portions as described under Operation.

Operation

Set-up and calibrate the Burst tester instrument according to the manufacturer's instructions for the instrument being used. Verify that the Burst tester program settings match those summarized in Table 3. Remove one sample portion from the sample stack holding the sample by the narrow edges, dipping the center of the sample into a pan filled approximately 1 in. (25 mm) from the top with distilled water. Leave the sample in the water for 4 (±0.5) seconds. Remove and drain excess water from the sample for 3 (±0.5)

seconds holding the sample in a vertical position. Drainage allows removal of excess water for protection of the burst tester electronics. Proceed with the test immediately after the drain step. Ensure the sample has no perforations in the area of the sample to be tested. Place the sample between the upper and lower rings. Center the wet sample flatly on the lower ring of the sample holding device. Lower the upper ring of the pneumatic holding device to secure the sample. Start the test. The test is over at sample failure (rupture). Record the maximum value. The plunger will automatically reverse and return to its original starting position. Raise the upper ring, remove and discard the tested sample. Repeat this procedure until all samples have been tested.

Calculations

Since some burst testers incorporate computer capabilities that support calculations, it may not be necessary to apply the following calculations to the test results. For example, the Thwing-Albert EJA and Intelect II STD Burst Tester can be operated through its menu and Program Settings options to support the calculations required for reporting wet burst results (see Tables 2 and 3). If these capabilities are not available, then calculate the appropriate average wet burst results as described below. The results are reported on the basis of a single sanitary tissue product sheet.

Wet Burst=sum of peak load readings/number of replicates tested

Deflection=sum of peak deflection readings/number of replicates tested

Burst Energy Absorption* to peak load (BEA)=sum of peak BEA readings/number of reps tested

*Burst Energy Absorption is the area of the stress/strain curve between pre-tension and peak load Reporting Results Report the Wet Burst results to the nearest gram Report the Deflection results to the nearest 0.1 inch Report the BEA results to the nearest 0.1 g*in/in$^2$

TABLE 2

Total number of usable units (sample sheets) tested

| Sample Description | Total # of usable units | Load divider |
|---|---|---|
| Finished Product | | |
| Towels | 4 | 1 |
| Facial | 8 | 2 |
| Napkins | 4 | 1 |
| Hankies | 8 | 2 |
| 1-Ply Toilet Tissue | 16 | 4 |
| 2-Ply/3-Ply/4-Ply Toilet Tissue | 8 | 2 |
| Handsheets | 4 | 1 |
| Wipes | 4 | 1 |

TABLE 3

Burst Tester Settings for a 2000 gram load cell

Burst Tester Settings for a 2000 gram load cell

| | | Intelect II STD Burst Tester |
|---|---|---|
| Set Mode | Manual | x |
| English/Metric | English | x |
| Curve Units | Load/deflection | x |
| Compression Units | Inches | |
| Load Units | Grams | x |

TABLE 3-continued

Burst Tester Settings for a 2000 gram load cell
Burst Tester Settings for a 2000 gram load cell

| | | Intelect II STD Burst Tester |
|---|---|---|
| Energy Units | BEA | x |
| Test over | Fail | x |
| Set Range | 100% | x |
| At Test End | Return | x |
| Pre-Test Speed | 5.00 inches/minute | |
| Test Speed | 5.00 inches/minute | x |
| Start of Test Speed | 5.00 inches/minute | |
| Start of Test distance | 0.100 inches | |
| Post-change-Speed | 5.00 inches/minute | |
| Return Speed | 20 or 40 inches/minute | x |
| Sampling Rate | 20 reading/second | x |
| Gauge length | 0.025 inches | |
| Adj. Gauge length | Adjusted | |
| Sample Thickness | 0.025 inches | |
| Chart Device | Manual | |
| Collision | Yes | x |
| Delay Time | 5 seconds delay | |
| Break Sensitivity | 20 grams | x |
| Size Sample | See Table 2 | |
| Load divider | See Table 2 | |
| Sample Diameter | 3.50 inches | x |
| Pre-Tension | 4.45 grams | |
| Sample shape | Circular | |

13. Panel Softness

Prior to softness testing, the paper samples to be tested are conditioned according to Tappi Method #T402OM-88. Here, samples are preconditioned for 24 hours at a relative humidity level of 10% to 35% and within a temperature range of 22° C. to 40° C. After this preconditioning step, samples should be conditioned for 24 hours at a relative humidity of 48% to 52% and within a temperature range of 22° C. to 24° C.

The softness panel testing takes place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness, two samples are presented such that the subject cannot see the samples, and the subject is required to choose one of them on the basis of tactile softness. The result of the test is reported in what is referred to as Panel Score Unit (PSU).

With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero-base standard. The number of panel tests performed and averaged is such that about 0.2 PSU represents a significant difference in subjectively perceived softness. The results of the panel softness testing on the exemplary products produced according to the process described herein are presented in Table 14 infra.

The results of the physical testing on the samples produced according the process described supra and some commercially available products are presented in Tables 4-12 provided infra.

TABLE 4

Exemplary Fraction Results From Fractionation of *Eucalyptus* Pulp at Different Process Conditions

| Condition | Effect. Width (μm) | Vessels/m | Vessels/g |
|---|---|---|---|
| Euc Feed | 118.7 | 6.13 | 100444 |
| 1 - Accepts | 118.6 | 5.43 | 88979 |
| 1 - Rejects | 120.6 | 9.23 | 148876 |
| 2 - Accepts | 120.4 | 5.43 | 92073 |
| 2 - Rejects | 120.8 | 8.99 | 138362 |
| 3 - Accepts | 0.115 | 6.46 | 104198 |
| 3 - Rejects | 0.125 | 7.88 | 125050 |
| 4 - Accepts | 120.9 | 4.32 | 70781 |
| 4 - Rejects | 116.6 | 7.39 | 117251 |

TABLE 5

Exemplary Physical Properties of 1-ply Commercially Available and Products Produced According to the Process Described Herein

| | Basis Weight (lb/3000 ft$^2$) | Total Dry Tensile (g/in) | Dry Tensile CD (g/in) | Dry Tensile MD (g/in) | Elongation CD (%) | Elongation MD (%) | Peak TEA-CD (g * in/in$^2$) | Peak TEA-MD (g * in/in$^2$) |
|---|---|---|---|---|---|---|---|---|
| Charmin Basic | 19.5 | 697 | 225 | 472 | 3.52 | 18.71 | 6.19 | 43.95 |
| Scott 1000 | 11 | 690 | 204 | 486 | 5.9 | 22.6 | 7.6 | 59 |
| Scott Extra Soft | 18.38 | 540 | 173 | 367 | 13.9 | 12.6 | 11.4 | 23.7 |
| Kroger PL | 12.62 | 411.5 | 107.5 | 304 | 8.76 | 18.42 | 5.35 | 30.05 |
| New product BASE Not Embossed | 15.76 | 297.7 | 89.3 | 208.3 | 9.27 | 27.87 | 4.77 | 27.90 |
| TEST 1 Not Embossed | 15.41 | 233.0 | 66.0 | 167.0 | 11.10 | 21.50 | 4.27 | 18.57 |
| TEST 2 Not Embossed | 15.28 | 227.3 | 66.3 | 161.0 | 12.26 | 24.83 | 4.93 | 20.40 |
| TEST 3 Not Embossed | 15.77 | 290.0 | 95.0 | 195.0 | 9.50 | 25.93 | 5.10 | 25.40 |

TABLE 6

Exemplary Physical Properties of 1-ply Commercially Available and Products Produced According to the Process Described Herein

| | Dry CD Modulus (g/cm %) | Dry MD Modulus (g/cm %) | Dry Modulus Geo. Mean (g/cm %) | Total Wet Tensile (g/in) | Wet Tensile CD (g/in) | Wet Tensile MD (g/in) | % Elongation CD Wet | % Elongation MD Wet |
|---|---|---|---|---|---|---|---|---|
| Charmin Basic | 1216.5 | 1224.25 | 1220.4 | 58 | 26 | 32 | 2.09 | 5.31 |
| Scott 1000 | 2152 | 1442 | 1761.6 | 12.63 | 3.69 | 8.94 | | 2.6 |
| Scott Extra Soft | 424 | 1177 | 706.4 | 12.42 | 4.25 | 8.17 | | 5.45 |
| Kroger PL | 606.5 | 768.67 | 682.8 | 12.55 | 3.38 | 9.17 | | 6.62 |
| New product BASE Not Embossed | 489.33 | 308.00 | 388.2 | 24.33 | 7.33 | 17.00 | 4.13 | 6.43 |
| TEST 1 Not Embossed | 284.33 | 360.00 | 319.9 | 31.33 | 9.00 | 22.33 | 6.13 | 7.67 |
| TEST 2 Not Embossed | 274.33 | 280.00 | 277.2 | 27.67 | 8.00 | 19.67 | 5.43 | 7.70 |
| TEST 3 Not Embossed | 510.67 | 336.00 | 414.2 | 37.33 | 12.00 | 25.33 | 6.97 | 8.87 |

TABLE 7

Exemplary Physical Properties of 1-ply Commercially Available and Products Produced According to the Process Described Herein

| | Peak TEA-CD Wet (g * in/in$^2$) | Peak TEA-MD Wet (g * in/in$^2$) | Wet CD Modulus (g/cm %) | Wet MD Modulus (g/cm %) | Wet Modulus Geo. Mean (g/cm %) |
|---|---|---|---|---|---|
| Charmin Basic | 0.53 | 1.63 | 52.5 | 75.25 | 62.9 |
| Scott 1000 | | 0.42 | | 16.1 | |
| Scott Extra Soft | | 0.72 | | 20.7 | |
| Kroger PL | | 6.62 | | 11.83 | |
| New product BASE Not Embossed | 0.53 | 0.93 | 9.67 | 19.00 | 13.6 |
| TEST 1 Not Embossed | 0.67 | 1.27 | 12.67 | 27.00 | 18.5 |
| TEST 2 Not Embossed | 0.67 | 1.17 | 9.67 | 22.00 | 14.6 |
| TEST 3 Not Embossed | 0.83 | 1.53 | 19.00 | 28.67 | 23.3 |

TABLE 8

Exemplary Physical Properties of 2-ply Commercially Available and Products Produced According to the Process Described Herein

| | Basis Weight (lb/3000 ft$^2$) | Caliper (mil) | Total Dry Tensile (g/in) | Dry Tensile CD (g/in) | Dry Tensile MD (g/in) | % CD Elongation | % MD Elongation |
|---|---|---|---|---|---|---|---|
| Charmin Ultra Soft | 31.22 | 23.51 | 531.5 | 174.56 | 356.94 | 11.69 | 25.67 |
| Charmin Ultra Strong | 24.81 | 21.01 | 747.4 | 253.75 | 493.69 | 12.16 | 18.83 |
| Cottonelle Clean Care | 25.9 | 23.4 | 557 | 191 | 366 | 9.6 | 14.9 |
| Cottonelle Ultra Comfort Care | 28.2 | 23.8 | 707 | 218 | 489 | 12 | 11.7 |
| Cottonelle Gentle Care | 25.49 | 21.4 | 533 | 195 | 338 | 8.1 | 14 |
| Quilted Northern Ultra Soft & Strong | 28.17 | 20.8 | 522 | 179 | 343 | 9 | 24.3 |
| Angel Soft | 24.54 | 18.6 | 530 | 148 | 382 | 10 | 27 |
| Kirkland Signature | 23.7 | 12 | 554 | 153 | 401 | 7 | 23 |
| Kirkland Signature Ultra Soft | 28.97 | 18.3 | 746.3 | 275.5 | 470.8 | 8 | 17.9 |
| Members Mark | 25.2 | 19.6 | 656 | 233 | 423 | 7.9 | 14.9 |
| White Cloud Ultra Soft and Thick | 31.04 | 17.8 | 820 | 211.5 | 608.5 | 8.16 | 17.38 |
| White Cloud Ultra Strong and Soft | 26.4 | 18.4 | 879 | 326 | 553 | 7.1 | 24.1 |
| Great Value Ultra Soft | 26.55 | 20 | 693 | 237 | 456 | 7.3 | 14.7 |
| Great Value Ultra Strong | 24.4 | 20 | 776 | 283 | 493 | 7.4 | 16.1 |
| CVS Total Home Ultra Soft | 25.08 | 21.2 | 730.6 | 272.8 | 457.8 | 9 | 16.7 |
| Kroger Ultra Strong | 25.9 | 21.1 | 735 | 288 | 447 | 6.8 | 22 |
| Kroger Ultra Soft | 31 | 22 | 712 | 268 | 444 | 7 | 24.5 |
| Target Up & Up Ultra Soft | 27.83 | 21.3 | 586 | 214.6 | 371.4 | 8 | 18.3 |
| Target Up & Up Soft | 27.08 | 16.55 | 662.5 | 205 | 457.5 | 7.56 | 19.13 |
| CVS Total Home Soft and Strong | 22.91 | 19.8 | 613.5 | 167 | 446.5 | 7.94 | 14.83 |
| New product BASE Embossed | 30.45 | 21.57 | 587.7 | 195.7 | 392.0 | 11.38 | 28.03 |
| TEST 1 Embossed | 30.04 | 21.03 | 549.0 | 168.0 | 381.0 | 11.55 | 24.33 |
| TEST 2 Embossed | 29.80 | 20.87 | 544.0 | 165.7 | 378.3 | 11.44 | 25.47 |
| TEST 3 Embossed | 30.42 | 20.97 | 556.7 | 178.3 | 378.3 | 10.53 | 25.07 |
| New product BASE Not Embossed | 31.37 | 21.93 | 597.3 | 201.3 | 396.0 | 10.57 | 30.60 |
| TEST 1 Not Embossed | 30.80 | 21.43 | 549.7 | 177.0 | 372.7 | 10.95 | 28.17 |
| TEST 2 Not Embossed | 30.99 | 21.47 | 529.0 | 173.0 | 356.0 | 10.93 | 27.43 |
| TEST 3 Not Embossed | 31.17 | 22.60 | 569.0 | 195.0 | 374.0 | 10.17 | 29.03 |

TABLE 9

Exemplary Physical Properties of 2-ply Commercially Available and Products Produced According to the Process Described Herein

| | Peak TEA-CD (g * in/in$^2$) | Peak TEA-MD (g * in/in$^2$) | Dry CD Modulus (g/cm %) | Dry MD Modulus (g/cm %) | Dry Modulus Geo. Mean (g/cm %) | Total Wet Tensile (g/in) | Wet Tensile CD (g/in) | Wet Tensile MD (g/in) |
|---|---|---|---|---|---|---|---|---|
| Charmin Ultra Soft | 11.12 | 48.30 | 715.31 | 759.13 | 736.9 | 55.1 | 18.00 | 37.13 |
| Charmin Ultra Strong | 16.78 | 50.13 | 909.38 | 1383.69 | 1121.7 | 63.3 | 21.50 | 41.75 |
| Cottonelle Clean Care | 8.3 | 27 | 708 | 913 | 804.0 | 32.9 | 11.9 | 21 |
| Cottonelle Ultra Comfort Care | 12.96 | 28 | 682 | 1313 | 946.3 | 32.2 | 10.9 | 21.3 |
| Cottonelle Gentle Care | 8.5 | 25 | 836.4 | 973.6 | 902.4 | 49.55 | 17.1 | 32.45 |
| Quilted Northern Ultra Soft & Strong | 9.5 | 40 | 1095 | 531 | 762.5 | 46.5 | 16.5 | 30 |
| Angel Soft | 9 | 59 | 921 | 884 | 902.3 | 27.34 | 7.64 | 19.7 |
| Kirkland Signature | 7 | 55 | 1080 | 814 | 937.6 | 35 | 9 | 26 |
| Kirkland Signature Ultra Soft | 12.6 | 36.5 | 1896.3 | 766 | 1205.2 | 49.75 | 18.85 | 30.9 |

TABLE 9-continued

Exemplary Physical Properties of 2-ply Commercially Available and Products Produced According to the Process Described Herein

| | Peak TEA-CD (g * in/in$^2$) | Peak TEA-MD (g * in/in$^2$) | Dry CD Modulus (g/cm %) | Dry MD Modulus (g/cm %) | Dry Modulus Geo. Mean (g/cm %) | Total Wet Tensile (g/in) | Wet Tensile CD (g/in) | Wet Tensile MD (g/in) |
|---|---|---|---|---|---|---|---|---|
| Members Mark | 9.9 | 28.8 | 1366 | 980 | 1157.0 | 15.7 | 6.1 | 9.6 |
| White Cloud Ultra Soft and Thick | 10.85 | 54.85 | 1521.5 | 1371.5 | 1444.6 | 16.75 | 5 | 11.75 |
| White Cloud Ultra Strong and Soft | 13.5 | 56.5 | 2270 | 685 | 1247.0 | 60.9 | 22.9 | 38 |
| Great Value Ultra Soft | 9.5 | 31 | 1551 | 1085 | 1297.2 | 19.9 | 7.6 | 12.3 |
| Great Value Ultra Strong | 11.7 | 36.1 | 1741 | 1040 | 1345.6 | 22.5 | 8.9 | 13.6 |
| CVS Total Home Ultra Soft | 13.9 | 33.4 | 1791 | 1057 | 1375.9 | 24.55 | 9.85 | 14.7 |
| Kroger Ultra Strong | 11 | 44 | 1934 | 639 | 1111.7 | 18 | 7.5 | 10.5 |
| Kroger Ultra Soft | 10.6 | 49 | 1897 | 602.8 | 1069.4 | 18.3 | 7.4 | 10.9 |
| Target Up & Up Ultra Soft | 10.1 | 32.9 | 1386.4 | 668 | 962.3 | 45.65 | 15.65 | 30 |
| Target Up & Up Soft | 8.68 | 45.5 | 1377.25 | 1047 | 1200.8 | 24.25 | 7.75 | 16.5 |
| CVS Total Home Soft and Strong | 8.35 | 34.75 | 1194.75 | 1148.75 | 1171.5 | 15 | 4.25 | 10.75 |
| New product BASE Embossed | 13.27 | 56.20 | 895.33 | 699.00 | 791.1 | 52.67 | 16.33 | 36.33 |
| TEST 1 Embossed | 11.70 | 47.50 | 761.33 | 766.67 | 764.0 | 55.67 | 17.33 | 38.33 |
| TEST 2 Embossed | 11.67 | 49.03 | 793.67 | 715.00 | 753.3 | 54.67 | 15.67 | 39.00 |
| TEST 3 Embossed | 11.43 | 48.30 | 922.67 | 746.33 | 829.8 | 60.00 | 18.00 | 42.00 |
| New product BASE Not Embossed | 12.60 | 61.67 | 990.33 | 656.00 | 806.0 | 51.67 | 16.67 | 35.00 |
| TEST 1 Not Embossed | 11.40 | 52.50 | 816.67 | 632.33 | 718.6 | 58.33 | 19.33 | 39.00 |
| TEST 2 Not Embossed | 11.40 | 50.60 | 850.67 | 680.33 | 760.7 | 56.33 | 18.67 | 37.67 |
| TEST 3 Not Embossed | 12.17 | 56.53 | 1064.67 | 687.00 | 855.2 | 64.33 | 20.33 | 44.00 |

TABLE 10

Exemplary Physical Properties of 2-ply Commercially Available and Products Produced According to the Process Described Herein

| | Elongation CD Wet (%) | Elongation MD Wet (%) | Peak TEA-CD Wet (g * in/in$^2$) | Peak TEA-MD Wet (g * in/in$^2$) | Wet CD Modulus (g/cm %) | Wet MD Modulus (g/cm %) | Wet Modulus Geo. Mean (g/cm %) |
|---|---|---|---|---|---|---|---|
| Charmin Ultra Soft | 11.53 | 12.05 | 1.67 | 2.63 | 23.00 | 68.69 | 39.7 |
| Charmin Ultra Strong | 11.51 | 11.67 | 1.86 | 2.78 | 30.88 | 126.63 | 62.5 |
| Cottonelle Clean Care | 6.02 | 10.9 | 0.75 | 1.6 | 23.6 | 35 | 28.7 |
| Cottonelle Ultra Comfort Care | 6.5 | 9.5 | 0.77 | 1.4 | 18.1 | 40 | 26.9 |
| Cottonelle Gentle Care | 7.9 | 13.7 | 1.13 | 2.76 | 31.35 | 59.5 | 43.2 |
| Quilted Northern Ultra Soft & Strong | 10 | 16.5 | 1.4 | 2.9 | 20.8 | 41 | 29.2 |
| Angel Soft | 6.33 | 6.9 | 0.74 | 1.4 | 15 | 21.3 | 17.9 |
| Kirkland Signature | 5 | 7 | 1 | 1 | 18 | 36 | 25.5 |
| Kirkland Signature Ultra Soft | 8.91 | 7.26 | 1.33 | 1.49 | 35.2 | 47.3 | 40.8 |
| Members Mark | 3.1 | 3.1 | 2 | 0.78 | 11.7 | 19.2 | 15.0 |
| White Cloud Ultra Soft and Thick | | 0.9 | | 0.4 | | 24 | |
| White Cloud Ultra Strong and Soft | 9.2 | 7.78 | 1.6 | 1.8 | 42.96 | 160 | 82.9 |
| Great Value Ultra Soft | 2.8 | 4.2 | 0.4 | 0.6 | 18.1 | 25.2 | 21.4 |
| Great Value Ultra Strong | 3.7 | 4.9 | 0.45 | 0.91 | 20.8 | 25.2 | 22.9 |
| CVS Total Home Ultra Soft | 5.28 | 5.22 | 0.73 | 0.73 | 18.8 | 28.95 | 23.3 |
| Kroger Ultra Strong | 2.8 | 3.8 | 0.83 | 0.28 | 18.5 | 16.9 | 17.7 |
| Kroger Ultra Soft | 2.6 | 3.75 | 0.59 | 0.58 | 18.5 | 15.44 | 16.9 |
| Target Up & Up Ultra Soft | 7.68 | 7.92 | 1.03 | 1.55 | 28.2 | 45.65 | 35.9 |
| Target Up & Up Soft | 7.58 | 2.3 | 7.58 | 0.65 | 7.75 | 29.5 | 15.1 |
| CVS Total Home Soft and Strong | | 2.85 | | 0.43 | | 16.75 | |
| New product BASE Embossed | 9.83 | 10.23 | 1.40 | 2.30 | 20.00 | 68.00 | 36.9 |
| TEST 1 Embossed | 10.47 | 10.47 | 1.50 | 2.47 | 20.33 | 99.67 | 45.0 |
| TEST 2 Embossed | 9.50 | 10.77 | 1.33 | 2.43 | 18.33 | 105.33 | 43.9 |
| TEST 3 Embossed | 10.13 | 11.17 | 1.50 | 2.60 | 21.33 | 150.00 | 56.6 |
| New product BASE Not Embossed | 9.73 | 11.07 | 1.37 | 2.33 | 21.00 | 63.33 | 36.5 |
| TEST 1 Not Embossed | 10.93 | 11.73 | 1.70 | 2.63 | 23.00 | 122.00 | 53.0 |
| TEST 2 Not Embossed | 11.17 | 11.40 | 1.70 | 2.57 | 23.33 | 69.00 | 40.1 |
| TEST 3 Not Embossed | 10.80 | 11.53 | 1.67 | 2.80 | 26.67 | 195.67 | 72.2 |

TABLE 11

Exemplary Physical Properties of 2-ply Commercially Available and Products Produced According to the Process Described Herein

| | Wet Decay CD 30 | Wet Decay MD 30 | Horizontal Absorbent Capacity (g/sheet) | Vertical Absorbent Capacity (g/sheet) | Horizontal Absorbent Capacity (g/g) | Vertical Absorbent Capacity (g/g) | Lint (avg) |
|---|---|---|---|---|---|---|---|
| Charmin Ultra Soft | | | 11.47 | 22.06 | 6.37 | 12.23 | 6.9 |
| Charmin Ultra Strong | | | 9.61 | 23.18 | 5.44 | 13.10 | 4.6 |
| Cottonelle Clean Care | | | 6.9 | 3.77 | 16.47 | 9 | 5.45 |
| Cottonelle Ultra Comfort Care | | | 10 | 5.2 | 21.5 | 11.2 | 3.8 |
| Cottonelle Gentle Care | 8.7 | 17.75 | | | | | |
| Quilted Northern Ultra Soft & Strong | | | 8 | 4.5 | 17 | 9.5 | 5 |
| Angel Soft | | | 6.8 | 3.24 | 16.56 | 7.8 | 3.4 |
| Kirkland Signature | | | 6 | 3 | 14 | 7 | 3 |
| Kirkland Signature Ultra Soft | 10.2 | 17.65 | 10 | 6 | 18 | 10 | 8 |
| Members Mark | | | 8.2 | 4.8 | 18.1 | 10.7 | 5 |
| White Cloud Ultra Soft and Thick | | | 8.25 | 4.45 | 15.7 | 8.48 | 2.35 |
| White Cloud Ultra Strong and Soft | | | 7.4 | 4.4 | 16.4 | 9.6 | 4.2 |
| Great Value Ultra Soft | | | 8 | 4.7 | 18 | 10.6 | 6 |
| Great Value Ultra Strong | | | 8.1 | 4.5 | 19.8 | 11.02 | 4.2 |
| CVS Total Home Ultra Soft | 4.7 | 7.85 | 9 | 4 | 16 | 9 | 6 |
| Kroger Ultra Strong | | | 7.9 | 4.5 | 18.5 | 10.6 | 4 |
| Kroger Ultra Soft | | | 8.9 | 5.2 | 17.2 | 10.1 | 6.5 |
| Target Up & Up Ultra Soft | 6.7 | 11.1 | 9 | 5 | 16 | 8 | 7 |
| Target Up & Up Soft | | | 6.95 | 3.53 | 15.85 | 8 | 5.23 |
| CVS Total Home Soft and Strong | | | 7.6 | 3.05 | 14.8 | 6.03 | 2.95 |
| New product BASE Embossed | 5.67 | 10.67 | 12.17 | 6.53 | 23.77 | 12.73 | 9.83 |
| TEST 1 Embossed | 5.67 | 11.33 | 12.13 | 6.17 | 24.17 | 12.27 | 10.20 |
| TEST 2 Embossed | 5.00 | 10.00 | 11.87 | 5.93 | 23.40 | 11.77 | 10.23 |
| TEST 3 Embossed | 6.33 | 12.00 | 11.73 | 6.23 | 23.07 | 12.27 | 9.40 |
| New product BASE Not Embossed | 5.67 | 10.33 | 11.93 | 6.20 | 22.90 | 11.87 | 10.73 |
| TEST 1 Not Embossed | 6.33 | 10.00 | 11.90 | 6.37 | 23.30 | 12.43 | 9.93 |
| TEST 2 Not Embossed | 6.33 | 11.33 | 10.53 | 6.30 | 20.40 | 12.20 | 10.77 |
| TEST 3 Not Embossed | 6.67 | 11.67 | 10.37 | 6.27 | 19.90 | 12.03 | 9.43 |

TABLE 12

Exemplary Physical Properties of 2-ply Commercially Available and Products Produced According to the Process Described Herein

| | Wet Burst (g) | Dry Burst (g) | Flexural Rigidity |
|---|---|---|---|
| Charmin Ultra Soft | 43 | 264 | |
| Charmin Ultra Strong | 33 | 371 | |
| Cottonelle Clean Care | 16 | 242 | |
| Cottonelle Ultra Comfort Care | 18 | 333 | 135 |
| Cottonelle Gentle Care | | 226 | 81 |
| Quilted Northern Ultra Soft & Strong | 26 | 217 | |
| Angel Soft | 18.57 | 221 | |
| Kirkland Signature | 14 | 176 | |
| Kirkland Signature Ultra Soft | 21 | 243.7 | |
| Members Mark | 5.9 | 249 | |
| White Cloud Ultra Soft and Thick | 3 | 268.25 | |
| White Cloud Ultra Strong and Soft | 28.1 | 254 | |
| Great Value Ultra Soft | 6.4 | 243 | |
| Great Value Ultra Strong | 8.6 | 284 | |
| CVS Total Home Ultra Soft | 10 | 266.4 | 165 |

TABLE 12-continued

Exemplary Physical Properties of 2-ply Commercially Available and Products Produced According to the Process Described Herein

| | Wet Burst (g) | Dry Burst (g) | Flexural Rigidity |
|---|---|---|---|
| Kroger Ultra Strong | 6.9 | 253 | |
| Kroger Ultra Soft | 6.8 | 228 | |
| Target Up & Up Ultra Soft | 20 | 239.2 | |
| Target Up & Up Soft | 7.5 | 242.75 | |
| CVS Total Home Soft and Strong | 4.25 | 205 | |
| New product BASE Embossed | 28.33 | 277.3 | 131.0 |
| TEST 1 Embossed | 32.67 | 249.7 | 112.1 |
| TEST 2 Embossed | 32.33 | 233.7 | 112.6 |
| TEST 3 Embossed | 34.67 | 259.7 | 112.9 |
| New product BASE Not Embossed | 26.33 | 263.7 | 156.8 |
| TEST 1 Not Embossed | 32.00 | 256.0 | 143.9 |
| TEST 2 Not Embossed | 29.00 | 259.0 | 123.1 |
| TEST 3 Not Embossed | 32.33 | 257.0 | 144.7 |

TABLE 13

Emtec Softness Data Results for 2-ply Test Products

| | BASE Embossed (dB $V^2$ rms) | TEST 1A Embossed Accepts on WS (dB $V^2$ rms) | TEST 1B Embossed Accepts on WS Rejects at F/C (dB $V^2$ rms) | TEST 2 Embossed Accepts on WS (dB $V^2$ rms) | BASE Not Embossed (dB $V^2$ rms) | TEST 1A Not Embossed Accepts on WS (dB $V^2$ rms) | TEST 1B Not Embossed Accepts on WS Rejects at F/C (dB $V^2$ rms) | TEST 2 Not Embossed Accepts on WS (dB $V^2$ rms) |
|---|---|---|---|---|---|---|---|---|
| TS7 | 6.69 | 6.03 | 5.87 | 6.54 | 6.32 | 5.79 | 6.00 | 6.50 |
| TS750 | 33.2 | 33.3 | 32.3 | 31.2 | 30.7 | 30.5 | 29.9 | 27.3 |

TABLE 14

Panel Softness Data Results for 2-ply Test Products

| BASE Embossed | TEST 1A Embossed Accepts on WS | TEST 1B Embossed Accepts on WS Rejects at F/C | TEST 2 Embossed Accepts on WS | BASE Not Embossed | TEST 1A Not Embossed Accepts on WS | TEST 1B Not Embossed Accepts on WS Rejects at F/C | TEST 2 Not Embossed Accepts on WS |
|---|---|---|---|---|---|---|---|
| — | 0.45 | 0.78 | 0.33 | — | 0.33 | 0.68 | 0.39 |

As provided in Tables 4-14 above, the exemplary new and unique test products developed by the fractionation process described herein are identified and provided as follows:

BASE (Embossed)–Outer (*Eucalyptus* feed pulp)/Inner (*Eucalyptus* feed pulp+softwood (NSK))

TEST 1 (Embossed) Outer (*Eucalyptus* Accepts 1)/Inner (*Eucalyptus* feed pulp+softwood (NSK))

TEST 2 (Embossed) Outer (*Eucalyptus* Accepts 1)/Inner (*Eucalyptus* rejects 1+softwood (NSK))

TEST 3 (Embossed) Outer (*Eucalyptus* Accepts 2)/Inner (*Eucalyptus* feed pulp+softwood (NSK))

BASE (Not Embossed) Outer (*Eucalyptus* feed pulp)/Inner (*Eucalyptus* feed pulp+softwood (NSK))

TEST 1 (Not Embossed) Outer (*Eucalyptus* Accepts 1)/Inner (*Eucalyptus* feed pulp+softwood (NSK))

TEST 2 (Not Embossed) Outer (*Eucalyptus* Accepts 1)/Inner (*Eucalyptus* rejects 1+softwood (NSK))

TEST 3 (Not Embossed) Outer (*Eucalyptus* Accepts 2)/Inner (*Eucalyptus* feed pulp+softwood (NSK))

where:

1=the first stage of a two-stage fractionation process is provided with process settings that provide a pressure drop of about 25.3 psi and the second stage is provided with process settings that provide a pressure drop of about 26.5 psi; and, 2=the first stage of a two-stage fractionation process is provided with process settings that provide a pressure drop of about 27.6 psi and the second stage is provided with process settings that provide a pressure drop of about 26.5 psi.

Figure 9:
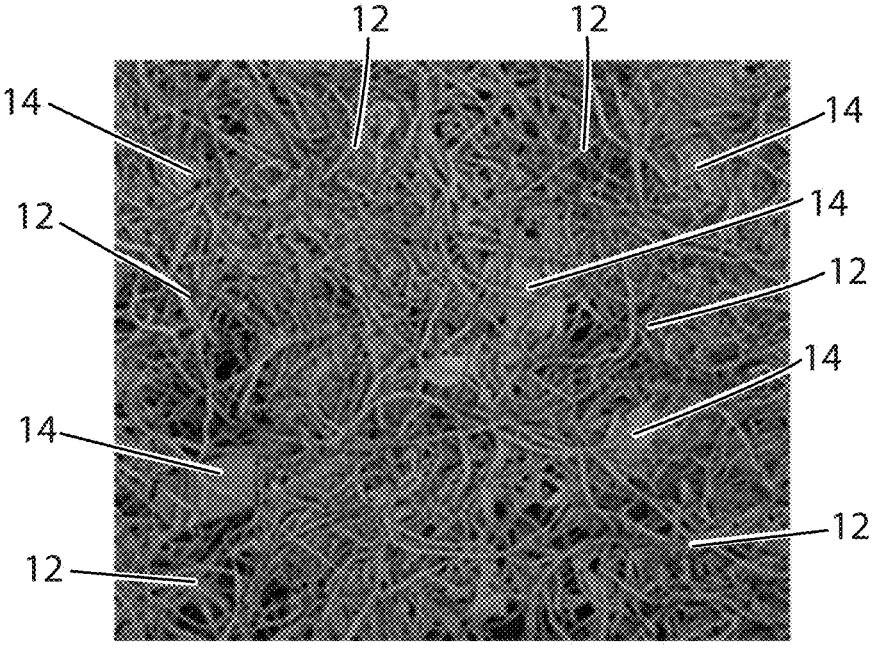
FIG. 9 is a photomicrograph showing a prior art consumer product showing both vessels and non-vessel fiber elements; and, FIG. 10 is a photomicrograph showing a consumer product produced by the process of the present disclosure having reduced vessel element content, increased strength, and softness.

FIG. 9 provides a photomicrograph of an exemplary prior art consumer product. This photomicrograph provides a magnified view of the surface structure of the exemplary prior art consumer product having both fibers 12 and vessel 14 elements. As can be seen the surface structure of the exemplary prior art consumer product shows a significant number of vessel 14 elements embedded on the surface and within the surface of the exemplary prior art consumer product. This exemplary product exhibits the currently understood softness/strength dynamic discussed supra. In other words, the overall softness of the resulting product has a direct effect on the overall strength of the consumer product.

Figure 10:
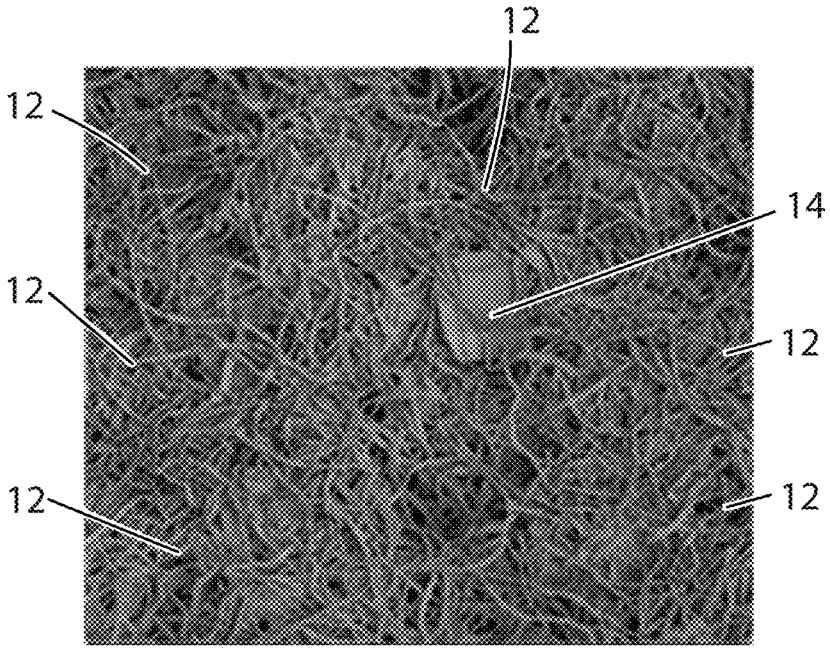

FIG. 10 provides a photomicrograph of an exemplary consumer product made by an exemplary papermaking process and incorporating pulp fibers hydrocyclonically treated according to the process described herein in an effort to minimize the presence of vessels 14 present in certain layers of the resulting consumer product. This photomicrograph provides a magnified view of the surface structure of the exemplary consumer product having fibers 12. As can be seen, the surface structure of the exemplary product shows a significantly reduced number of vessel 14 elements embedded on the surface and within the surface of the exemplary prior art consumer product.

As shown in Tables 13-14, the product resulting from the fractionation process described herein exhibits the exemplary properties provided supra and changes the currently understood softness/strength dynamic discussed supra. In other words, the product produced according to the techniques disclosed herein can be provided in a manner that turns the currently understood softness/strength rubric on its head. It is now possible to provide a product that exhibits significant strength yet can be appreciated by the consumer to have heretofore unrealizable softness. This is clearly a consumer desirable attribute that has clearly not been realizable until now. As evidenced by the tabulated data, there is a strong correlation in the objective physical properties related to softness (e.g., TS7, TS750) as measured by the techniques discussed supra in the products produced by the fractionation process described herein and the subjective results of the panel softness study (PSU). There is also concrete evidence in the strength-related objective measurements of the products produced by the fractionation process described herein and the objective physical properties related to softness.

The BASE embossed and not embossed products and the 6 test product configurations (i.e., Test 1-3 embossed and not embossed) are shown schematically in FIGS. 11-14. As shown, the outer layer of each ply of each Test two-ply substrate can be formed from an aqueous slurry of *eucalyptus* (Brazilian bleached hardwood kraft pulp) feed pulp fibers treated by a two-stage fractionation process comprising product stream "accepts" having a lower percentage of vessels than the feed pulp. The inner layer of each ply of a two-ply substrate can be formed from either an aqueous slurry of feed pulp fibers treated by a two-stage fractionation process comprising the product stream "rejects" having a higher percentage of vessels than the feed pulp or un-fractionated feed pulp. It should be understood by one of skill in the art that the resulting two-ply products can comprise outer layers of "accepts" and inner layers of "rejects" and/or untreated pulp material.

Figure 11:
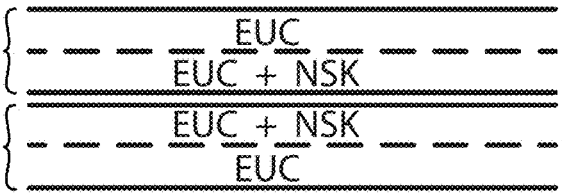
FIG. 11 is a schematic representation of an exemplary 2-ply web material where each ply is formed from a layer of *Eucalyptus* feed pulp fibers and a layer of a mixture comprising a blend of *Eucalyptus* feed pulp fibers and northern softwood kraft (NSK) fibers.

FIG. 11 shows a schematic view of the BASE embossed and not embossed products. The outer layer of each ply can be formed from an aqueous slurry of *eucalyptus* (Brazilian bleached hardwood kraft pulp) un-fractionated feed pulp fibers. The inner layer can be formed from a combination of an aqueous slurry of *eucalyptus* (Brazilian bleached hardwood kraft pulp) un-fractionated feed pulp fibers and NSK fibers.

Figure 12:
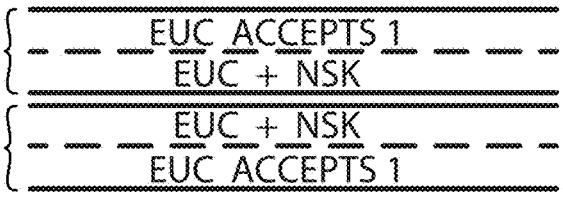
FIG. 12 is a schematic representation of another exemplary 2-ply web material where each ply is formed from a layer of the "accept" fraction from hydrocyclonically treated *Eucalyptus* feed pulp fibers and a layer comprising a mixture of *Eucalyptus* feed pulp fibers and NSK fibers.

FIG. 12 shows a schematic view of the Test 1 product comprising a two-ply substrate wherein each ply provides an outer layer comprising "accepts." The first stage of an exemplary two-stage fractionation process is provided with process settings that provide a pressure drop of about 25.3 psi and the second stage is provided with process settings that provide a pressure drop of about 26.5 psi. The inner layer can be formed from an aqueous slurry comprising a combination of *eucalyptus* (Brazilian bleached hardwood kraft pulp) un-fractionated feed pulp fibers and NSK fibers.

Figure 13:
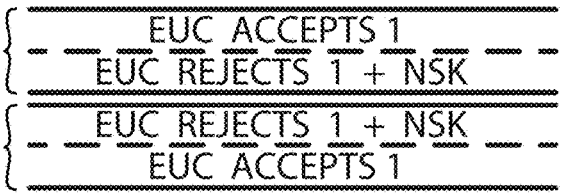
FIG. 13 is a schematic representation of yet another exemplary 2-ply web material where each ply is formed from a layer of the "accept" fraction from hydrocyclonically treated *Eucalyptus* feed pulp fibers and a layer comprising a mixture of the "reject" fraction from hydrocyclonically treated *Eucalyptus* feed pulp fibers and NSK fibers.

FIG. 13 shows a schematic view of the Test 2 product comprising a two-ply substrate wherein each ply provides an outer layer comprising "accepts." The first stage of an exemplary two-stage fractionation process that produces the accepts is provided with process settings that provide a pressure drop of about 25.3 psi and the second stage is provided with process settings that provide a pressure drop of about 26.5 psi. The inner layer of each ply comprises a combination of "rejects" and NSK fibers. The first stage of an exemplary two-stage fractionation process is provided with process settings that provide a pressure drop of about 25.3 psi and the second stage is provided with process settings that provide a pressure drop of about 26.5 psi.

Figure 14:
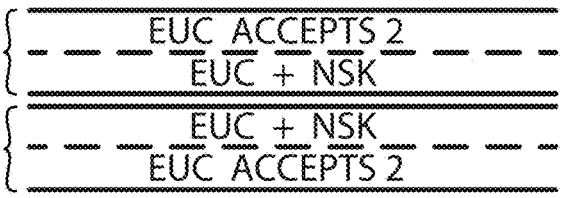
FIG. 14 is a schematic representation of still yet another exemplary 2-ply web material where each ply is formed from a layer of the "accept" fraction from hydrocyclonically treated *Eucalyptus* feed pulp fibers at a different pressure and a layer comprising a mixture of *Eucalyptus* feed pulp fibers and NSK fibers.

FIG. 14 shows a schematic view of the Test 3 product comprising a two-ply substrate wherein each ply provides an outer layer comprising "accepts." The first stage of a two-stage fractionation process is provided with process settings that provide a pressure drop of about 27.6 psi and the second stage is provided with process settings that provide a pressure drop of about 26.5 psi. The inner layer can be formed from an aqueous slurry comprising a combination of *eucalyptus* (Brazilian bleached hardwood kraft pulp) un-fractionated feed pulp fibers and NSK fibers.

Figure 15:
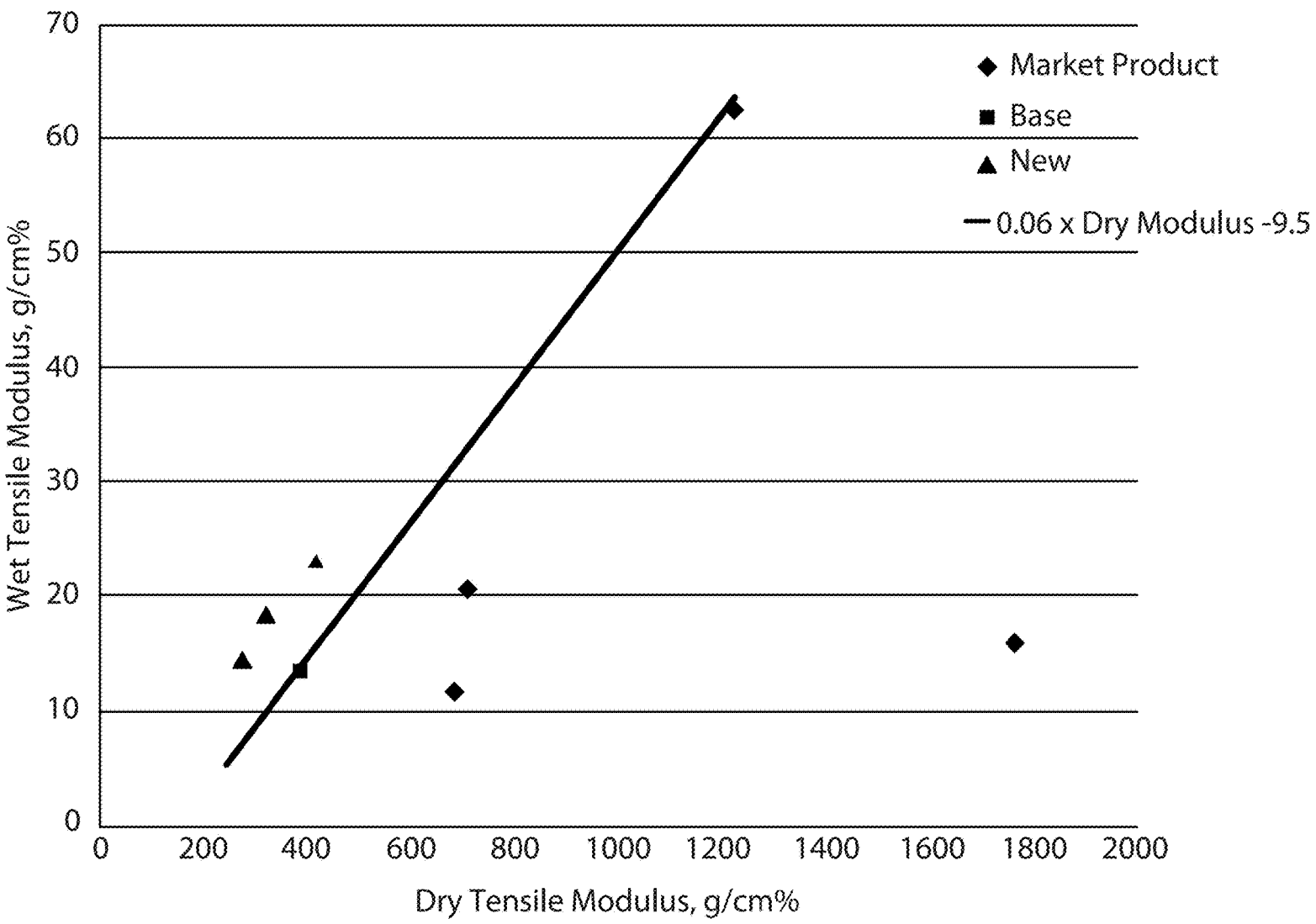
FIG. 15 is a graphical representation of the relationship between wet tensile modulus (in g/cm) and dry tensile modulus (in g/cm) for various 1-ply commercially available substrates and the substrates produced by the process described herein; and, FIG. 16 is a graphical representation of the relationship between wet tensile modulus (in g/cm) and dry tensile modulus (in g/cm) for various 2-ply commercially available substrates and the substrates produced by the process described herein.

As can be seen in FIG. 15, a plot of the geometric mean of wet modulus versus the geometric mean of dry modulus for six, 1-ply test product configurations (i.e., Test 1-3 embossed and not embossed) data provided in Tables 5-7, infra, provides an equation represented by:

Geometric Mean Wet Tensile
Modulus>0.06*Geometric Mean Dry Tensile
Modulus−9.5

Figure 16:
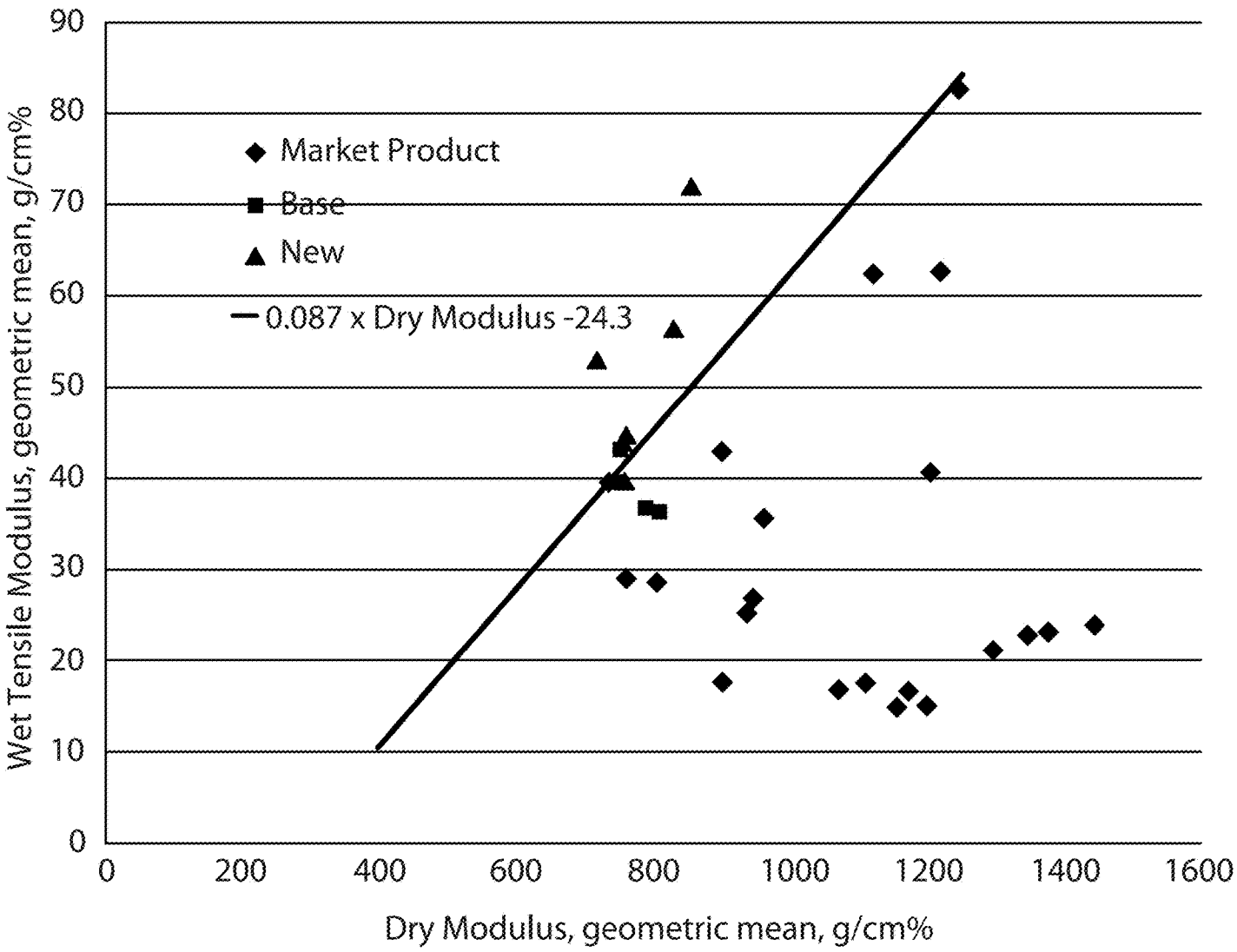

As can be seen in FIG. 16, a plot of the geometric mean of wet modulus versus the geometric mean of dry modulus for six, 2-ply test product configurations (i.e., Test 1-3 embossed and not embossed) data provided in Tables 8-12, infra, provides an equation represented by:

Geometric Mean Wet Tensile
Modulus>0.087*Geometric Mean Dry Tensile
Modulus−24.3

Additional Examples a. A process for manufacturing a web material, the process comprising the steps of:
   a) providing a pulp material comprising fibers and vessels;
   b) separating said vessels from said fibers in said pulp material to form a slurry having at least about 7 percent less vessels per meter than said pulp material;
   c) processing said slurry to form said web material.

b. The process of a. further comprising the step of separating said vessels from said fibers with a hydrocyclone.

c. The process of any of a. through b. wherein said step b) further comprises the step of creating an accepts stream and a rejects stream, said accepts stream having less vessels than said rejects stream.

d. The process of c. further comprising the step of separating said vessels from said fibers in said rejects stream to form a slurry having at least about 7 percent less vessels than said rejects stream.

e. The process of c. further comprising the step of processing said rejects stream to create a second accepts stream and a second rejects stream, said second accepts stream having less vessels than said second rejects stream.

f. The process of e. further comprising the step of adding said second accepts stream to said slurry.

g. The process of any of a. through f. wherein said step c) further comprises the step of depositing said slurry on a foraminous forming wire.

h. The process of g. further comprising the step of dewatering said slurry disposed upon said foraminous forming wire to a fiber consistency ranging from about 40 percent to about 80 percent.

i. The process of h. further comprising the step of transferring said dewatered slurry to a foraminous forming member.

j. The process of i. further comprising the step of dewatering said slurry disposed upon said foraminous forming member.

k. The process of j. further comprising the step of transferring said dewatered slurry from said foraminous forming member to a surface of a through air dryer.

l. The process of k. further comprising the step of creping said dewatered slurry from said surface of said through air dryer to form said web material.

m. The process of l. further comprising the step of winding said web material.

n. A process for manufacturing a papermaking slurry, said process comprising the steps of:
   a) providing a pulp material comprising fibers and vessels;
   b) separating said vessels from said fibers in said pulp material to form said papermaking slurry having at least about 7 percent less vessels per meter than said pulp material.

o. The process of n. wherein said step b) further comprises the step of separating said vessels from said fibers with a hydrocyclone.

p. The process of any of n. through o. wherein said step of separating said vessels from said fibers in said pulp material further comprises the step of creating accepts stream and a rejects stream, said accepts stream having less vessels than said rejects stream.

q. The process of any of n. through p. further comprising the step of separating said vessels from said fibers in said rejects stream to form a slurry having at least about 7 percent less vessels than said rejects stream.

r. A process for manufacturing a papermaking slurry, said process comprising the steps of:
   a) providing a pulp material comprising fibers;
   b) separating fibers having an average width of at less than about 50 μM from said pulp material;
   c) forming said papermaking slurry from said separated fibers.

s. The process of r. wherein said step b) further comprising the step of separating said fibers with a hydrocyclone.

t. The process of any of r. through s. wherein said step of separating said fibers with a hydrocyclone further comprises the step of creating accepts stream and a rejects stream, said accepts stream having more fibers having an average width of at less than about 50 μM.

u. A single ply web material formed from a pulp material and comprising a first layer and a second layer, said first layer having at least about 7 percent less vessels per meter than said pulp material.

v. The single ply web material of u. wherein said web material has a Geometric Mean Wet Tensile Modulus >0.06*Geometric Mean Dry Tensile Modulus−9.5.

w. The single ply web material of any of u. through v. wherein said web material is not embossed.

x. The single ply web material of any of u. through w. wherein said web material has a total dry tensile value of less than 290 g/in.

y. The single ply web material of any of u. through x. wherein said web material has a CD wet elongation value of greater than 4.13%.

z. The single ply web material of any of u. through y. wherein said Geometric Mean Wet Tensile Modulus is less than 23.3.

aa. The single ply web material of any of u. through z. wherein said web material has a CD wet peak TEA value of greater than 0.53 g*in/in$^2$.

bb. The single ply web material of any of u. through aa. wherein said web material has a MD wet peak TEA value of greater than 0.93 g*in/in$^2$.

cc. The single ply web material of any of u. through bb. wherein said web material has a CD dry tensile value of less than 95.0 g/in.

dd. The single ply web material of any of u. through cc. wherein said web material has a MD dry tensile value of less than 208.3 g/in.

ee. A multiple ply web material formed from a first ply formed from a pulp material and comprising a first layer and a second layer, said first layer having at least about 7 percent less vessels per meter than said pulp material.

ff. The multiple ply web material of ee. wherein said web material has a Geometric Mean Wet Tensile Modulus >0.087*Geometric Mean Dry Tensile Modulus−24.3.

gg. The multiple ply web material of any of ee. through ff. wherein said web material has a total dry tensile value of less than 587.7 g/in.

hh. The multiple ply web material of any of ee. through gg. wherein said web material has a CD wet elongation value of greater than 9.5%.

ii. The multiple ply web material of any of ee. through hh. wherein said Geometric Mean Wet Tensile Modulus is less than 56.6.

jj. The multiple ply web material of any of ee. through ii. wherein said web material has a CD wet peak TEA value of greater than 1.33 g*in/in$^2$.

kk. The multiple ply web material of any of ee. through jj. wherein said web material has a MD wet peak TEA value of greater than 2.33 g*in/in$^2$.

ll. The multiple ply web material of any of ee. through kk. wherein said web material has a CD dry tensile value of less than 201.3 g/in.

mm. The multiple ply web material of any of ee. through ll. wherein said web material has a MD dry tensile value of less than 396.0 g/in.

nn. The multiple ply web material of any of ee. through mm. wherein said web material has a TS7 value of greater than 5.79 db V$^2$ rms.

oo. The multiple ply web material of any of ee. through nn. wherein said web material is embossed.

pp. The multiple ply web material of oo. wherein said web material has a TS7 value of greater than 5.87 db V$^2$ rms.

qq. The multiple ply web material of any of ee. through pp wherein said web material is creped.

rr. The multiple ply web material of any of ee. through nn. wherein said web material is not embossed.

ss. The multiple ply web material of qq. wherein said web material has a TS7 value of greater than 5.79 db V$^2$ rms.

tt. The multiple ply web material of any of ee. through ss. wherein said first layer is formed from a slurry wherein said slurry is formed from a pulp comprising separated fibers having an average width of at less than about 50 μM.

uu. The multiple ply web material of any of ee. through tt. wherein said web material is creped.

vv. The multiple ply web material of any of ee. through uu. wherein said web material is through air dried.

ww. The multiple ply web material of any of ee. through vv. wherein said web material is selected from the group consisting of paper towel, bath tissue, and facial tissue.

xx. The single ply web material of any of u. through dd. wherein said first layer is formed from a slurry wherein said slurry is formed from a pulp comprising separated fibers having an average width of at less than about 50 μM.

yy. The multiple ply web material of any of u. through dd. wherein said web material is creped.

zz. The multiple ply web material of any of u. through dd. and ww. through yy. wherein said web material is through air dried.

aaa. The multiple ply web material of any of u. through dd. and ww. through zz. wherein said web material is selected from the group consisting of paper towel, bath tissue, and facial tissue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for manufacturing a multi-ply web material comprising a layered first ply and a layered second ply, the process comprising the steps of:

a) providing a pulp material comprising fibers and vessels;

b) separating the vessels from the fibers in the pulp material to form an accepts stream having at least 7 percent less vessels per meter than the pulp material, and a rejects stream having 15% more vessels per meter than the pulp material;

c) processing the accepts stream to form at least a portion of an outer layer of the first ply and/or at least a portion of an outer layer of the second ply; and d) separating fibers having an average width of at less than 50 μM from said pulp material.

2. The process of claim 1, further comprising the step of separating the vessels from the fibers with a hydrocyclone.

3. The process of claim 1, further comprising the step of processing the rejects stream to create a second accepts stream and a second rejects stream, the second accepts stream having less vessels than the second rejects stream.

4. The process of claim 3, further comprising the step of adding the second accepts stream to the accepts stream.

5. The process of claim 1, wherein the step c) further comprises the step of depositing the accepts stream on a foraminous forming wire.

6. The process of claim 5, further comprising the step of dewatering the accepts stream disposed upon the foraminous forming wire.

7. The process of claim 6, further comprising the step of transferring the dewatered accepts stream to a foraminous forming member.

8. The process of claim 7, further comprising the step of dewatering the accepts stream disposed upon the foraminous forming member.

9. The process of claim 8, further comprising the step of predrying the dewatered accepts stream through use of a blow-through pre-dryer.

10. The process of claim 9, further comprising the step of transferring the predried accepts stream from the foraminous forming member to a surface of a Yankee dryer.

11. The process of claim 10, further comprising the step of drying the pre-dried accepts stream on the surface of the Yankee dryer.

12. The process of claim 11, further comprising the step of creping the dried accepts stream from the surface of the Yankee dryer to form at least a portion of the outer layer of the first ply and/or at least a portion of the outer layer of the second ply of the multi-ply web material.

13. A process for manufacturing a layered web material, the process comprising the steps of:

a) providing a pulp material comprising fibers and vessels;

b) separating the vessels from the fibers in the pulp material to form an accepts stream having at least 7 percent less vessels per meter than the pulp material, and a rejects stream having 15% more vessels per meter than the pulp material;

c) processing the accepts stream to form at least a portion of an outer layer of the layered web material; and d) separating fibers having an average width of at less than 50 μM from said pulp material.

14. The process of claim 13, further comprising the step of separating the vessels from the fibers with a hydrocyclone.

15. The process of claim 13, further comprising the step of processing the rejects stream to create a second accepts stream and a second rejects stream, the second accepts stream having less vessels than the second rejects stream.

16. The process of claim 14, further comprising the step of adding the second accepts stream to the accepts stream.

17. A process for manufacturing a multi-ply web material comprising a first ply having at least an inner layer and an outer layer, and a second ply having at least an inner layer and an outer layer, the process comprising the steps of:

a) providing a pulp material comprising fibers and vessels;

b) separating the vessels from the fibers in the pulp material to form an accepts stream having at least 7 percent less vessels per meter than the pulp material, and a rejects stream having 15% more vessels per meter than the pulp material;

c) processing the accepts stream to form at least a portion of an outer layer of the first ply and/or at least a portion of an outer layer of the second ply;

d) processing the rejects stream to form at least a portion of an inner layer of the first ply and/or at least a portion of the inner layer of the second ply; and e) separating fibers having an average width of at less than 50 μM from said pulp material.

18. The process of claim 17, further comprising the step of separating the vessels from the fibers with a hydrocyclone.

19. The process of claim 17, further comprising the step of processing the rejects stream to create a second accepts stream and a second rejects stream, the second accepts stream having less vessels than the second rejects stream.

20. The process of claim 19, further comprising the step of adding the second accepts stream to the accepts stream.

* * * * *